US012035763B2

(12) United States Patent
Janda et al.

(10) Patent No.: US 12,035,763 B2
(45) Date of Patent: Jul. 16, 2024

(54) ARTICLE OF CLOTHING WITH CONTROL BUTTON

(71) Applicant: MILWAUKEE ELECTRIC TOOL CORPORATION, Brookfield, WI (US)

(72) Inventors: Timothy Janda, Elkhorn, WI (US); Justin D. Dorman, Madison, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 527 days.

(21) Appl. No.: 17/244,520

(22) Filed: Apr. 29, 2021

(65) Prior Publication Data

US 2021/0244107 A1 Aug. 12, 2021

Related U.S. Application Data

(63) Continuation of application No. 14/933,761, filed on Nov. 5, 2015, now Pat. No. 11,033,059.

(Continued)

(51) Int. Cl.
*A41D 13/005* (2006.01)

(52) U.S. Cl.
CPC ..... *A41D 13/0051* (2013.01)

(58) Field of Classification Search
CPC ..... A41D 1/002; A41D 1/005; A41D 1/04; A41D 3/00; A41D 13/1281;

(Continued)

(56) References Cited

U.S. PATENT DOCUMENTS 1,288,408 A 12/1918 Hait et al.
1,691,472 A 11/1928 Graham et al.

(Continued)

FOREIGN PATENT DOCUMENTS

CN 1258201 A 6/2000
CN 300874882 1/2009

(Continued)

OTHER PUBLICATIONS

"Convertible Heated Soft-shell Jacket", http://www.plusheat.com/by-brand/convertible-heated-soft-shell-jacket.html, pp. 1-20, 2010.

(Continued)

*Primary Examiner* — Vy T Nguyen
(74) *Attorney, Agent, or Firm* — Michael Best & Friedrich LLP

(57) ABSTRACT

An article of clothing comprising an electronic button assembly including an interface having a face and a base. The face defines a face periphery including a first top edge, a first bottom edge, a first right edge, a first left edge, a first lower slanted corner, and a first upper slanted corner. The base defines a base periphery extending beyond the face periphery on all sides to provide structural support to the face. The base periphery has a shape complimentary to a shape of the face periphery. A heater is electrically coupled to the electronic button assembly. An outer shell is coupled to the electronic button assembly. The outer shell has an outer surface and sewing edges folded inwardly and defining a shell opening receiving the interface. A shape of the shell opening follows the shape of the face periphery. The base is disposed beneath the outer shell.

15 Claims, 25 Drawing Sheets

Related U.S. Application Data

(60) Provisional application No. 62/076,001, filed on Nov. 6, 2014.

(58) Field of Classification Search
CPC ..... A41D 13/0051; A41D 27/06; A41D 2400/12; H05B 2203/036; H05B 3/342; H05B 1/0272; H05B 2203/017; H05B 2203/003; H05B 2203/014; H05B 2203/005; H05B 2203/013; H05B 2203/016; H05B 2203/029; H05B 3/145; H05B 2203/011; H05B 3/00; H05B 3/34; H05B 3/36; H05B 1/02; H05B 1/0227; H05B 1/0244; H05B 2203/002; H05B 2203/015; H05B 2203/026; H05B 2203/035; H05B 2214/04; H05B 3/0014; H05B 3/267; H05B 3/56; H05B 3/565; H05B 3/84; H05B 3/845; H05B 45/60; H05B 47/00
USPC .... 2/102, 108, 255; 219/211, 529, 549, 494, 219/483, 492, 527, 535, 548, 201, 486, 219/487, 490, 506, 520, 528, 543, 545
See application file for complete search history.

(56) References Cited

U.S. PATENT DOCUMENTS 1,702,583 A 2/1929 Williams
2,150,251 A 3/1939 Shanhouse
2,156,504 A 5/1939 Liss
D115,484 S 6/1939 Smith
2,277,772 A 3/1942 Marick
2,567,192 A 9/1951 De Grazia
2,581,366 A 1/1952 De Grazia
2,685,021 A 7/1954 Duncan
2,707,284 A 5/1955 Artzt
2,727,241 A 12/1955 Smith
2,873,449 A 2/1959 Herbert
D189,233 S 11/1960 Gardner et al.
3,084,241 A 4/1963 Carrona
3,125,762 A 3/1964 Glahe
3,293,405 A 12/1966 Costanzo
3,392,264 A 7/1968 Arron
3,398,406 A 8/1968 Waterbury
3,501,616 A 3/1970 Arron
3,663,796 A 5/1972 Hines et al.
3,748,436 A 7/1973 Cossaboom
3,953,935 A 5/1976 Reiner et al.
3,988,780 A 11/1976 Armellino
3,989,924 A 11/1976 Kurtzer
3,999,037 A 12/1976 Metcalf, Sr.
4,273,989 A 6/1981 Hinton et al.
4,279,255 A 7/1981 Hoffman
4,302,850 A 12/1981 Maeshima
4,322,858 A 4/1982 Douglas
4,404,460 A 9/1983 Kerr
D271,154 S 11/1983 Dowling
4,475,252 A 10/1984 Peyser et al.
4,483,020 A 11/1984 Dunn
4,507,877 A 4/1985 Vaccari et al.
4,539,700 A 9/1985 Sato
4,554,682 A 11/1985 Hillquist
4,589,134 A 5/1986 Waldron
4,645,325 A 2/1987 Inoue et al.
4,777,344 A 10/1988 Nash et al.
4,827,534 A 5/1989 Haugen
D301,797 S 6/1989 Lariviere
4,860,388 A 8/1989 Dean
4,876,724 A 10/1989 Suzuki
D306,511 S 3/1990 Jones
D309,665 S 8/1990 Moseley
4,985,934 A 1/1991 Perry
5,008,517 A 4/1991 Brekkstran et al.
D318,362 S 7/1991 Aiken
5,031,246 A 7/1991 Kronenberger
5,032,705 A 7/1991 Batchellar et al.
5,101,511 A 4/1992 Elverskog
5,101,515 A 4/1992 Holt et al.
5,105,067 A 4/1992 Brekkstran et al.
5,148,002 A 9/1992 Kuo et al.
D330,106 S 10/1992 Aubuchon et al.
5,158,039 A 10/1992 Clark
5,169,225 A 12/1992 Palm
D332,514 S 1/1993 Brandoff
5,206,957 A 5/1993 Gulick
5,230,333 A 7/1993 Yates et al.
D338,773 S 8/1993 Wilde
5,245,721 A 9/1993 Lowe et al.
D341,471 S 11/1993 Cross
5,302,806 A 4/1994 Simmons et al.
5,302,807 A 4/1994 Zhao
D356,883 S 4/1995 Ganahl
5,416,310 A 5/1995 Little
5,451,747 A 9/1995 Sullivan et al.
5,465,424 A 11/1995 Cudney et al.
5,471,767 A 12/1995 Walker
5,499,401 A 3/1996 Heinmiller
5,603,646 A 2/1997 Tobias
5,605,144 A 2/1997 Simmons et al.
5,606,346 A 2/1997 Tobias
5,611,085 A 3/1997 Rasmussen
5,617,583 A 4/1997 Yates et al.
D385,088 S 10/1997 Handysides
5,777,296 A 7/1998 Bell
5,784,626 A 7/1998 Odaohara
5,826,273 A 10/1998 Eckes
5,832,538 A 11/1998 Williams
D402,788 S 12/1998 Blankenship, Jr.
5,866,881 A 2/1999 Jones, III
5,893,991 A 4/1999 Newell
D414,013 S 9/1999 Group
5,953,758 A 9/1999 Foster
D414,913 S 10/1999 Katz et al.
5,977,517 A 11/1999 Grosjean
D421,329 S 3/2000 Adams
6,049,062 A 4/2000 Jones
6,060,693 A 5/2000 Brown
6,078,025 A 6/2000 Yeung
D429,058 S 8/2000 Derosier
6,098,612 A 8/2000 Nakamoto et al.
6,119,270 A 9/2000 Chou
6,155,841 A 12/2000 Spanyar
D437,673 S 2/2001 DesJardins et al.
6,199,210 B1 3/2001 Feldman
D439,727 S 4/2001 Hosogai
6,232,674 B1 5/2001 Frey et al.
6,239,410 B1 5/2001 Tackore
6,319,015 B1 11/2001 Faunce
6,320,161 B1 11/2001 Hansen, Jr.
6,329,638 B1 12/2001 Bloodworth
6,333,570 B1 12/2001 Ilg
6,342,692 B1 1/2002 Hart et al.
6,350,129 B1 2/2002 Gorlick
6,374,418 B1 4/2002 Rindle
D457,711 S 5/2002 Mahhabir et al.
6,408,440 B1 6/2002 Phillips
6,439,942 B1 8/2002 Pillai et al.
D463,094 S 9/2002 Haselmayer et al.
6,450,168 B1 9/2002 Nguyen
6,519,779 B1 * 2/2003 Taguchi ..... A42B 1/248 2/209.12
6,550,471 B2 4/2003 Szymocha et al.
6,558,016 B1 5/2003 Restauro
6,561,814 B2 5/2003 Tilbury et al.
6,563,424 B1 5/2003 Kaario
6,598,235 B2 7/2003 Bulla
6,649,873 B1 11/2003 Cintron, Jr. et al.
6,654,963 B2 12/2003 Fayle et al.
D487,426 S 3/2004 Johnson
6,738,984 B2 5/2004 Gillen et al.
6,792,124 B2 9/2004 Tilbury et al.
D498,037 S 11/2004 Bay

(56) References Cited

U.S. PATENT DOCUMENTS 6,826,782 B2 12/2004 Jordan
6,840,955 B2 1/2005 Ein
6,854,988 B2 2/2005 Marmaropoulos et al.
6,888,111 B1 5/2005 Tobin
D508,601 S 8/2005 Hoyt
6,963,055 B2 11/2005 Rock et al.
D526,467 S 8/2006 Kent
D526,469 S 8/2006 Collier
D527,868 S 9/2006 Wager
D529,687 S 10/2006 Rindle
7,117,538 B2 10/2006 Bosne et al.
D539,508 S 4/2007 Rogers et al.
7,210,939 B2 5/2007 Marmaropou et al.
7,230,206 B1 6/2007 Randall
D551,429 S 9/2007 Wager
D553,329 S 10/2007 Wager
D553,330 S 10/2007 Wager
D555,878 S 11/2007 Bay
D566,927 S 4/2008 Graham et al.
D568,581 S 5/2008 Wager
7,375,308 B2 5/2008 Ferguson
D573,312 S 7/2008 Siepmann
D580,630 S 11/2008 Adams et al.
7,448,874 B2 11/2008 Willis
7,462,035 B2 12/2008 Lee et al.
RE40,613 E 1/2009 Jordan
D584,482 S 1/2009 Marsh
7,476,104 B2 1/2009 Marmaropoulos et al.
D588,338 S 3/2009 Self
D588,783 S 3/2009 Olstorn
7,496,969 B2 3/2009 Pieczynski
7,519,192 B1 4/2009 Laycock et al.
7,559,768 B2 7/2009 Marmaropoulos et al.
7,560,664 B2 7/2009 Ford et al.
D598,639 S 8/2009 Holder
7,618,260 B2 11/2009 Daniel et al.
7,624,453 B2 12/2009 Rene et al.
7,651,016 B2 1/2010 Stewart
D609,432 S 2/2010 Jennings
7,653,949 B2 2/2010 Kraus et al.
D615,731 S 5/2010 Oneto, Sr.
7,731,517 B2 6/2010 Lee et al.
7,739,748 B2 6/2010 Nilforushan et al.
7,753,685 B2 7/2010 Lee et al.
D622,937 S 9/2010 Bay
7,816,628 B2 10/2010 Fernandez et al.
7,816,632 B2 10/2010 Bourke, III et al.
D626,725 S 11/2010 Snyder et al.
D627,540 S 11/2010 Claeys
D628,771 S 12/2010 Kanada et al.
D631,393 S 2/2011 Shani et al.
D632,215 S 2/2011 Shani et al.
7,886,368 B2 2/2011 Hood
D636,973 S 5/2011 Smith et al.
D638,612 S 5/2011 Benderradji
D639,025 S 6/2011 Holder
7,959,351 B1 6/2011 Thorpe
7,966,667 B2 6/2011 Tomlinson et al.
D641,137 S 7/2011 Evans et al.
7,994,752 B2 8/2011 Soar
8,008,606 B2 8/2011 Kaiserman et al.
D648,924 S 11/2011 Propst
8,062,797 B2 11/2011 Fisher et al.
8,105,371 B1 1/2012 Giocondo, Jr.
8,107,653 B2 1/2012 Wolfe
D653,836 S 2/2012 Woyshner et al.
D654,664 S 2/2012 Evans et al.
8,144,911 B2 3/2012 Chiang et al.
8,157,570 B2 4/2012 Chen
D662,282 S 6/2012 Meunier-Bouchard
D662,285 S 6/2012 Rushworth
8,251,157 B2 8/2012 Gray et al.
D669,500 S 10/2012 Dangerfield
D671,714 S 12/2012 McCarroll
D672,531 S 12/2012 Kelfer
D677,861 S 3/2013 Perry
D685,160 S 7/2013 Savage
D689,670 S 9/2013 Lorenc
D692,082 S 10/2013 Lee
D692,212 S 10/2013 Coward
8,564,249 B2 10/2013 Lundqvist et al.
D693,093 S 11/2013 Pasloski
D693,094 S 11/2013 Pasloski
D693,096 S 11/2013 Russo
D693,543 S 11/2013 Rao
D698,524 S 2/2014 Roberts et al.
D698,525 S 2/2014 Roberts et al.
D698,528 S 2/2014 Roberts et al.
D702,419 S 4/2014 Mertes
D703,922 S 5/2014 Roberts et al.
D704,849 S 5/2014 Hunter
D704,924 S 5/2014 Roberts et al.
D707,017 S 6/2014 Wolf et al.
D707,423 S 6/2014 Pezzimenti
D707,424 S 6/2014 Pezzimenti
D707,923 S 7/2014 Borovicka et al.
D710,573 S 8/2014 Pezzimenti
D713,128 S 9/2014 Pezzimenti et al.
D713,620 S 9/2014 Pezzimenti et al.
D713,621 S 9/2014 Pezzimenti et al.
D714,022 S 9/2014 Mong et al.
D714,526 S 10/2014 Ingram
D714,527 S 10/2014 Borovicka
D716,022 S 10/2014 Judge et al.
D729,690 S 5/2015 Rivirere
D732,799 S 6/2015 Smith
D733,400 S 7/2015 Cunningham
D734,922 S 7/2015 Docker
D736,496 S 8/2015 Gonzalez
D754,947 S 5/2016 Borovicka
D755,478 S 5/2016 Grosbol
D757,398 S 5/2016 Ingram
D765,351 S 9/2016 Shaw
D766,844 S 9/2016 Turksu et al.
D808,616 S 1/2018 Dorman
D842,819 S 3/2019 Maetani et al.
D866,487 S 11/2019 Dorman
11,033,059 B2 6/2021 Janda et al.
D962,876 S 9/2022 Altonen et al.
D986,187 S 5/2023 Altonen et al.
D988,291 S 6/2023 Ebersole
2001/0047992 A1 12/2001 Deangelis et al.
2002/0076949 A1 6/2002 Tilbury et al.
2002/0142112 A1 10/2002 Tarrell
2003/0051286 A1 3/2003 Gregg
2003/0074712 A1 4/2003 Liao
2004/0069761 A1 4/2004 Carr et al.
2004/0070996 A1 4/2004 Carr
2004/0133962 A1 7/2004 Baumel
2004/0153012 A1 8/2004 Schroeder
2004/0221362 A1 11/2004 Bosne et al.
2004/0237169 A1 12/2004 Wood et al.
2004/0256381 A1 12/2004 Haas et al.
2004/0257038 A1 12/2004 Johnson et al.
2005/0007406 A1 1/2005 Haas et al.
2005/0217004 A1 10/2005 Haberfeld
2005/0246826 A1 11/2005 McCarter et al.
2006/0001727 A1 1/2006 Haas et al.
2006/0048263 A1 3/2006 Walsh
2006/0060576 A1 3/2006 Haas et al.
2006/0128169 A1 6/2006 Marmaropoulos et al.
2006/0166520 A1 7/2006 Marmaropoulos et al.
2006/0213895 A1 9/2006 Dennis
2006/0227675 A1 10/2006 Fried
2006/0277652 A1 12/2006 Okajima
2007/0045269 A1 3/2007 Vassallo
2007/0118960 A1 5/2007 Goodwin
2007/0130667 A1 6/2007 Gagnon et al.
2007/0151593 A1 7/2007 Jaynes
2007/0287035 A1 12/2007 Marmaropoulos et al.
2008/0005825 A1 1/2008 Tronvold
2008/0023460 A1 1/2008 Huang
2008/0024438 A1 1/2008 Collins et al.
2008/0045269 A1 2/2008 Emory

(56) References Cited

U.S. PATENT DOCUMENTS

| | | | | |
|---|---|---|---|---|
| 2008/0067163 | A1 | 3/2008 | Axinte et al. | |
| 2008/0083740 | A1 | 4/2008 | Kaiserman et al. | |
| 2008/0163404 | A1 | 7/2008 | Carpentier et al. | |
| 2008/0184459 | A1 | 8/2008 | Barnes | |
| 2008/0223844 | A1 | 9/2008 | Cronn | |
| 2009/0014436 | A1 | 1/2009 | Toya et al. | |
| 2009/0032520 | A1 | 2/2009 | Cronn | |
| 2009/0094725 | A1 | 4/2009 | Smith et al. | |
| 2009/0158493 | A1 | 6/2009 | Kim | |
| 2009/0178173 | A1 | 7/2009 | Schultz | |
| 2009/0217440 | A1 | 9/2009 | Sutker | |
| 2009/0230112 | A1 | 9/2009 | Ducharme et al. | |
| 2009/0249529 | A1 | 10/2009 | Rodriguez et al. | |
| 2009/0271917 | A1 | 11/2009 | Richardson | |
| 2009/0289046 | A1 | 11/2009 | Richmond | |
| 2009/0310290 | A1 | 12/2009 | Tennent | |
| 2010/0031424 | A1 | 2/2010 | Sharpe et al. | |
| 2010/0100997 | A1 | 4/2010 | Lee et al. | |
| 2010/0115684 | A1 | 5/2010 | Freedman et al. | |
| 2010/0186137 | A1 | 7/2010 | Gutshe | |
| 2010/0198043 | A1 | 8/2010 | Holzer et al. | |
| 2010/0263603 | A1 | 10/2010 | Baron | |
| 2010/0283295 | A1 | 11/2010 | Smith et al. | |
| 2010/0299800 | A1 | 12/2010 | Jackson | |
| 2011/0012552 | A1 | 1/2011 | Margalit | |
| 2011/0016609 | A1 | 1/2011 | Phelps et al. | |
| 2011/0093998 | A1 | 4/2011 | Brennan | |
| 2011/0108538 | A1 | 5/2011 | Gray et al. | |
| 2011/0173731 | A1 | 7/2011 | McElroy et al. | |
| 2011/0185469 | A1 | 8/2011 | Santuccio et al. | |
| 2011/0260556 | A1 | 10/2011 | Partridge et al. | |
| 2011/0306218 | A1 | 12/2011 | Chen | |
| 2012/0060260 | A1 | 3/2012 | Kochling | |
| 2012/0062571 | A1 | 3/2012 | Malek | |
| 2012/0074128 | A1 | 3/2012 | Blackford et al. | |
| 2012/0091115 | A1 | 4/2012 | Mironichev et al. | |
| 2012/0096622 | A1 | 4/2012 | Johnson | |
| 2012/0298493 | A1 | 11/2012 | Hogan et al. | |
| 2013/0019379 | A1 | 1/2013 | Shadid | |
| 2013/0037531 | A1 | 2/2013 | Gray et al. | |
| 2013/0042383 | A1 | 2/2013 | Ryan et al. | |
| 2013/0212772 | A1 | 8/2013 | Apostoloff | |
| 2013/0227757 | A1* | 9/2013 | Chen | A41D 13/0051 2/69 |
| 2013/0276201 | A1 | 10/2013 | Pezzimenti | |
| 2013/0334194 | A1* | 12/2013 | Chen | H05B 1/0272 219/490 |
| 2014/0246416 | A1 | 9/2014 | White | |
| 2014/0310847 | A1 | 10/2014 | Ulriksen et al. | |
| 2015/0060430 | A1 | 3/2015 | Tsuge et al. | |
| 2015/0271873 | A1 | 9/2015 | Gray et al. | |
| 2017/0013889 | A1 | 1/2017 | Chen | |

FOREIGN PATENT DOCUMENTS

| | | | |
|---|---|---|---|
| CN | 303045022 | | 12/2014 |
| DE | 20012075 | U1 | 11/2000 |
| DE | 20012530 | U1 | 11/2000 |
| DE | 102004029017 | | 1/2008 |
| EM | 000082607-0002 | | 2/2004 |
| EM | 000082607-0003 | | 2/2004 |
| FR | 2793116 | A1 | 11/2000 |
| GB | 2158693 | A | 11/1985 |
| JP | 6251757 | A | 9/1994 |
| JP | 2000064112 | A | 2/2000 |
| JP | D1203602 | | 4/2004 |
| JP | D1220383 | | 10/2004 |
| NO | 20090182-0010 | | 11/2009 |
| RU | 00047131 | | 5/2000 |
| RU | 00089193 | | 7/2004 |
| WO | WO2012034416 | A1 | 3/2012 |

OTHER PUBLICATIONS

Battery Powered 12V Compatible, http://www.electricblanket.net/p-96-heated-electric-jacket-battery-12-volt-compatable.aspx, pp. 1-4, 1999.

Series and Parallel Battery Configurations and Information, <https://batteryuniversity.com/index.php/learn/article/serial_and_parallel_battery_configurations>, Jun. 18, 2019 (4 pages).

The Home Depot. http://www.homedepot.com/p/Mi lwaukee-Large-M 12-Lithium-Ion-Cordless-Black-MZ-Heated-Jacket-Kit-2345-L/203461266. Customer Review from Sep. 2012. "Large M12 Lithium-Ion Cordless Black MZ Heated Jacket Kit".

REI Windbreaker Fleece Vest—All Around Sturdy Bargain of a Vest, Announced Dec. 2, 2014 [Site Visited Jul. 11, 2016] http://www.getoutdoorgear.com/1129/rei-windbrake-fleece-vest-all-around-sturdy-bargain-of-a-vest/.

Schott Shot Padding Primaloft Vest nylon Cotton Padded Vest, Announced Oct. 25, 2014 [Site Visited Jul. 11, 2016 ] http ://global. rakuten .com/en/store/super-rag/item/3142034/?s-id=borderless_recommend item_en.

Weight Vest for Osteoporosis—Alternative Solutions, Announced Aug. 20, 2013 [ Site Visited Jul. 11, 2016] http://weightvest4osteoporosis.com/.

Burton 2013 Women's Tonic Snowboard Jacket Bright White Colorblock, Announced date N/A [Site Visited Aug. 10, 2016] http://www.xbusa.com/burton-2013-women-s-tonic-snowboard-jacket-bright-white-colorblock.html.

For 3M Fanatics, Vapor Flash Jacket—p. 23—Nike Talk, Announced Dec. 9, 2014 [Site Visited Aug. 10, 2016] http://niketalk.com/t/319284/for-3m-fanatics-vapor-flash-jacket/6606.

Hardshell Jacket 'Rebirth' in 2011?—Gear Junkie, Announced Nov. 18, 2010 [Site Visited Aug. 10, 2016] https://gearjunkie.com/waterproof-breathable-hardshell-jackets-2011.

Dewbu, "Dewbu Heated Jacket for Women with 12V Battery Pack Winter Outdoor Soft Shell Electric Hearing Coat," <https://www.amazon.com/dp/B07HR9XHPF/ref=sspa_dk_detail_0?ie=UTF8&psc=1&pd_rd_i=B07HR9XHPFp13NParams&s=apparel&sp_%E2%80%A6> web page visited Jun. 6, 2023 (11 pages).

Milwaukee Electric Tool, "M12™ Heated Jacket (Jacket Only), " <https://www.milwaukeetool.com/Products/Work-Gear/Heated-Gear/Heated-Jackets/2390> web page visited Jun. 6, 2023 (3 pages).

Milwaukee Electric Tool, "Women's Large M12 12-Volt Lithium-Ion Cordless Axis Black Heated Quilted Jacket Kit with One 3.0 Ah Battery and Charger," <https://www.homedepot.com/p/Milwaukee-Women-s-Large-M12-12-Volt-Lithium-Ion-Cordless-AXIS-Black-Heated-Quilted-Jacket-Kit-with-One-3-0-Ah-Battery-and-Charger-234B-212X/321401962> web page visited Jun. 6, 2023 (6 pages).

Ptahdus, "Ptahdus Women's Heated Jacked with Battery Pack 7.4V, with Hand Warmer Pocket," <https://www.amazon.com/PTAHDUS-Womens-Battery-XX-Large-Amaranth/dp/B089QMK4NJ/ref=asc_df_B089QMK4NJ/?tag=hyprod-20&linkCode=%E2%80%A6> web page visited Jun. 6, 2023 (11 pages).

* cited by examiner

ARTICLE OF CLOTHING WITH CONTROL BUTTON

CROSS-REFERENCE TO RELATED APPLICATIONS

This application is a continuation application of U.S. patent application Ser. No. 14/933,761, filed Nov. 5, 2015, now U.S. Pat. No. 11,033,059, which claims priority to U.S. Provisional Patent Application No. 62/076,001, filed Nov. 6, 2014, the entire contents of all of which are incorporated herein by reference.

FIELD OF INVENTION

The present invention generally relates to clothing articles and, more particularly, to a clothing article with an electronic control button.

SUMMARY

In one independent aspect, an article of clothing includes an electronic button assembly including an interface having a face and a base. The face defines a face periphery including a first top edge, a first bottom edge, a first right edge, a first left edge, a first lower slanted corner, and a first upper slanted corner. The base defines a base periphery extending beyond the face periphery on all sides to provide structural support to the face, the base periphery having a shape complimentary to a shape of the face periphery and including a second top edge, a second bottom edge, a second right edge, a second left edge, a second lower slanted corner, and a second upper slanted corner. The article of clothing also includes a heater electrically coupled to the electronic control button assembly, and an outer shell coupled to the electronic button assembly. The outer shell has an outer surface and sewing edges. The sewing edges are folded inwardly and define a shell opening receiving the interface. A shape of the shell opening follows the shape of the face periphery. The base is disposed beneath the outer shell.

In another independent aspect, an article of clothing includes an electronic button assembly including an interface having a face and a base. The face defines a face periphery having a generally rectangular shape with two opposite corners cut-out as defined by six edges. The base defines a base periphery extending beyond the face periphery on all sides to provide structural support to the face. The article of clothing also includes a heater electrically coupled to the electronic control button assembly, and an outer shell coupled to the electronic button assembly. The outer shell has an outer surface and sewing edges. The sewing edges are folded inwardly and define a shell opening receiving the interface. A shape of the shell opening follows the shape of the face periphery. The base is disposed beneath the outer shell.

In yet another independent aspect, an article of clothing includes an electronic button assembly including an interface having a face and a base. The face defines a face periphery. The base defines a base periphery extending beyond the face periphery on all sides to provide structural support to the face. The base periphery has a shape complimentary to a shape of the face periphery. A heater is electrically coupled to the electronic control button assembly. An outer shell is coupled to the electronic button assembly. The outer shell has an outer surface and sewing edges. The sewing edges are folded inwardly and define a shell opening receiving the interface. A shape of the shell opening follows the shape of the face periphery. The base is disposed beneath the outer shell. A first protective layer defines an opening aligned with the shell opening. The sewing edges are folded inwardly toward the first protective layer and attached to the first protective layer. The first protective layer is disposed between the outer shell and the base. A second protective layer is disposed on a back side of the interface opposite the outer shell. The second protective layer is configured to at least partially cover the back side of the interface. The base is disposed between the first and second protective layers. The base is coupled to the first and second protective layers.

Other independent aspects of the invention will become apparent by consideration of the detailed description, claims and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Figure 1:
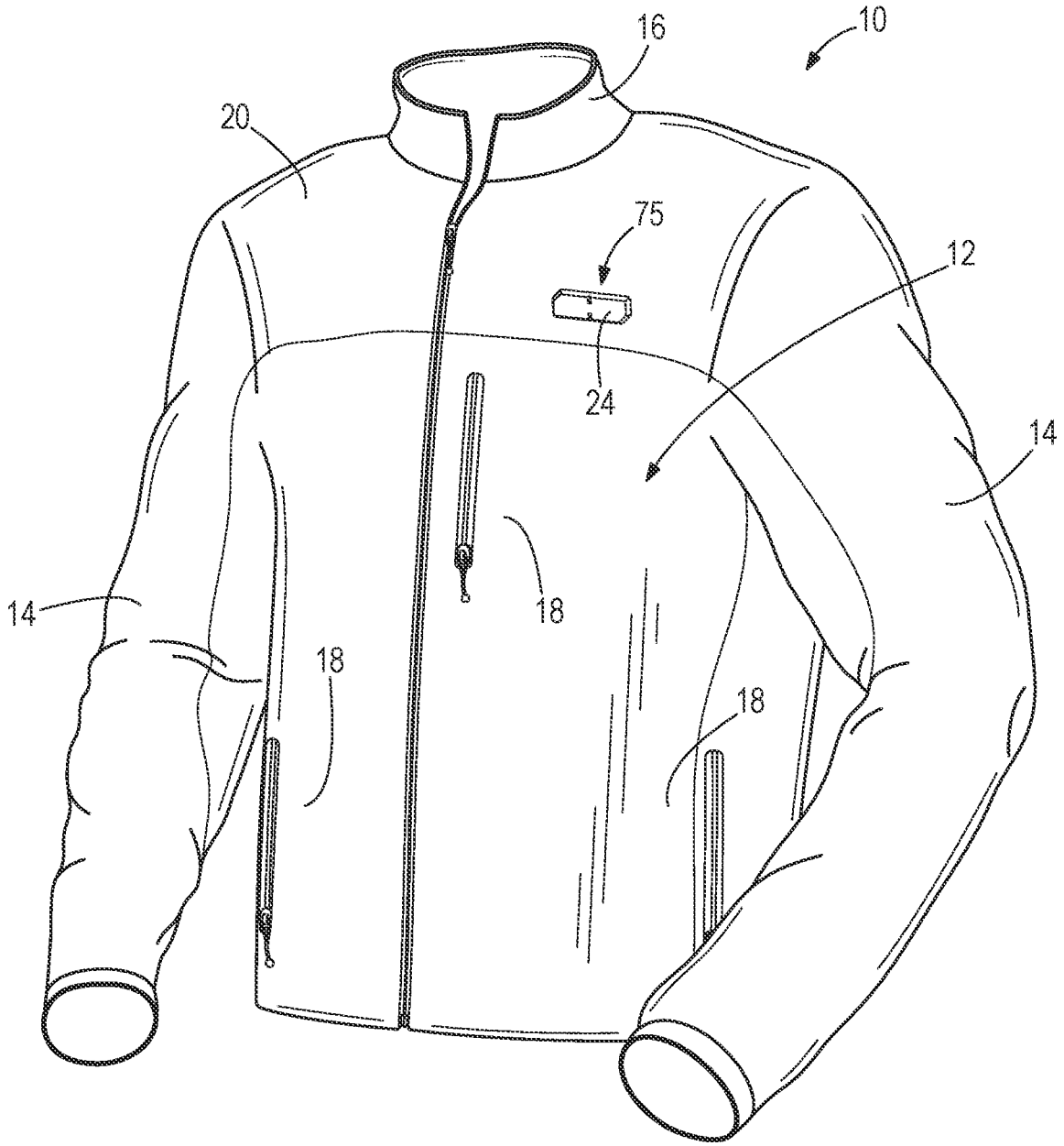
FIG. 1 is a front perspective view of a jacket.

FIG. 1 illustrates an article of clothing, such as a jacket 10, including an electrical component to be controlled. In the illustrated construction, the jacket 10 is a heated jacket similar to that described and illustrated in U.S. Patent Application Publication No. US2011/0108538A1, published May 12, 2011, and in U.S. Patent Application Publication No. US2013/0037531A1, published Feb. 14, 2013, the entire contents of both of which are hereby incorporated by reference. In other constructions (not shown), the jacket 10 may include, in addition to or as an alternative to a heating component, another component to be controlled, such as, for example, a component for cooling, illumination, communication, power supply, combinations thereof, etc.

The jacket 10 may be constructed in various sizes to fit a variety of users. The jacket 10 includes typical jacket features such as a torso body 12, arms 14, a collar 16, and front pockets 18. In other constructions (not shown), the article of clothing may have another configuration (e.g., overalls, a vest, a hooded garment, pants, etc.).

Figure 2:
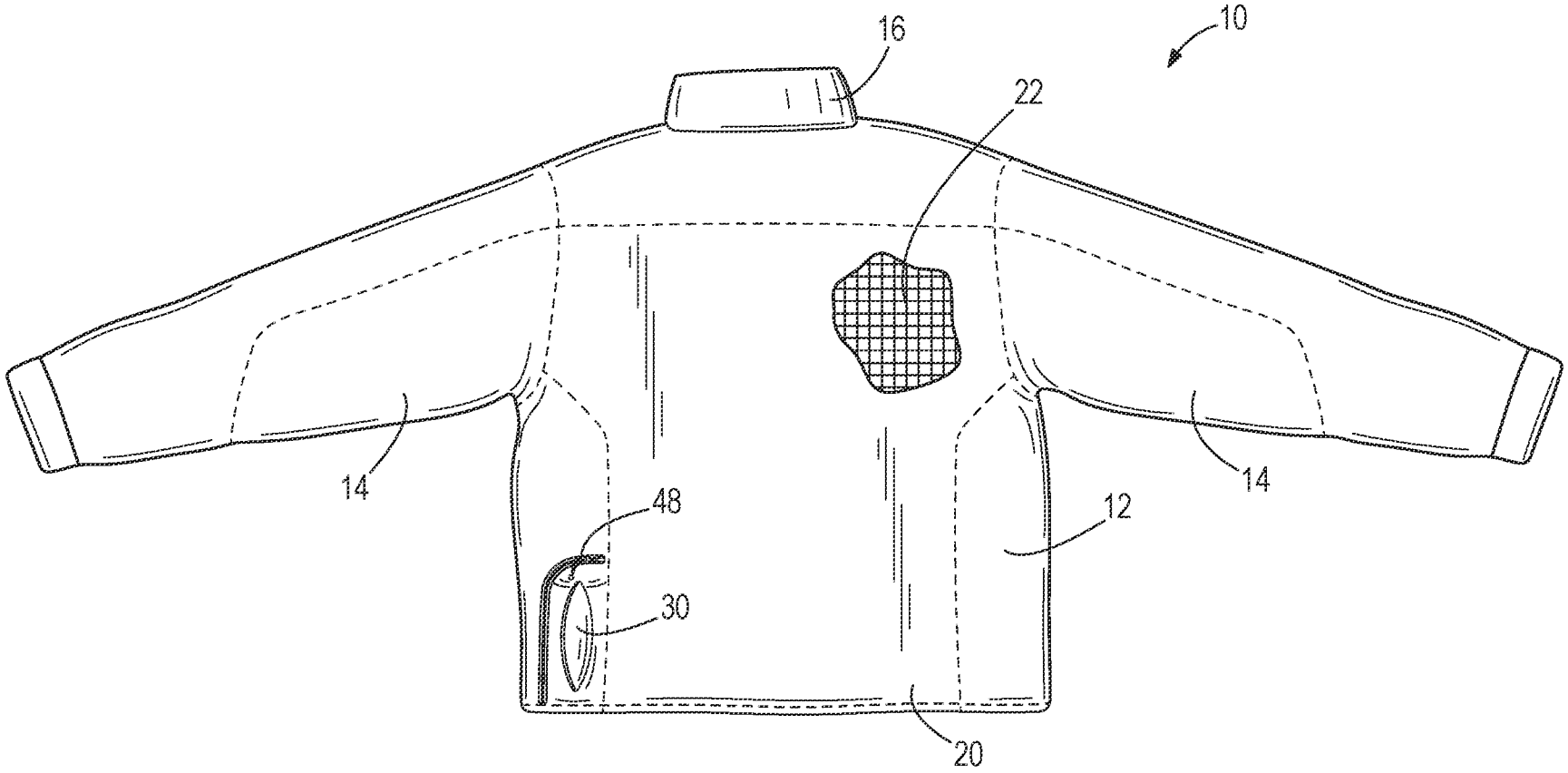
FIG. 2 is a back view of the jacket shown in FIG. 1.

The jacket 10 also includes an outer shell 20 and an inner shell 22 (FIG. 2). In the illustrated embodiment, the outer shell 20 is made from a polyester material and is constructed to protect the user from wind, rain, and other weather elements. In some embodiments, the outer shell 20 has an outer surface that is exposed to the elements and that may be waterproof, windproof, or a combination thereof. The inner shell 22 provides an inner lining for the jacket 10 for additional warmth and comfort. In some embodiments, the inner shell 22 lines the inside of the jacket including the torso body 12, the arms 14, the collar 16, and the pockets 18. In other embodiments, the inner shell 22 lines only select areas of the jacket 10. For example, in some embodiments, the inner shell 22 lines the torso body 12, but not the arms 14. The inner shell 22 is coupled to the outer shell 20 by sewing along at least the borders of the jacket 10.

Figure 3:
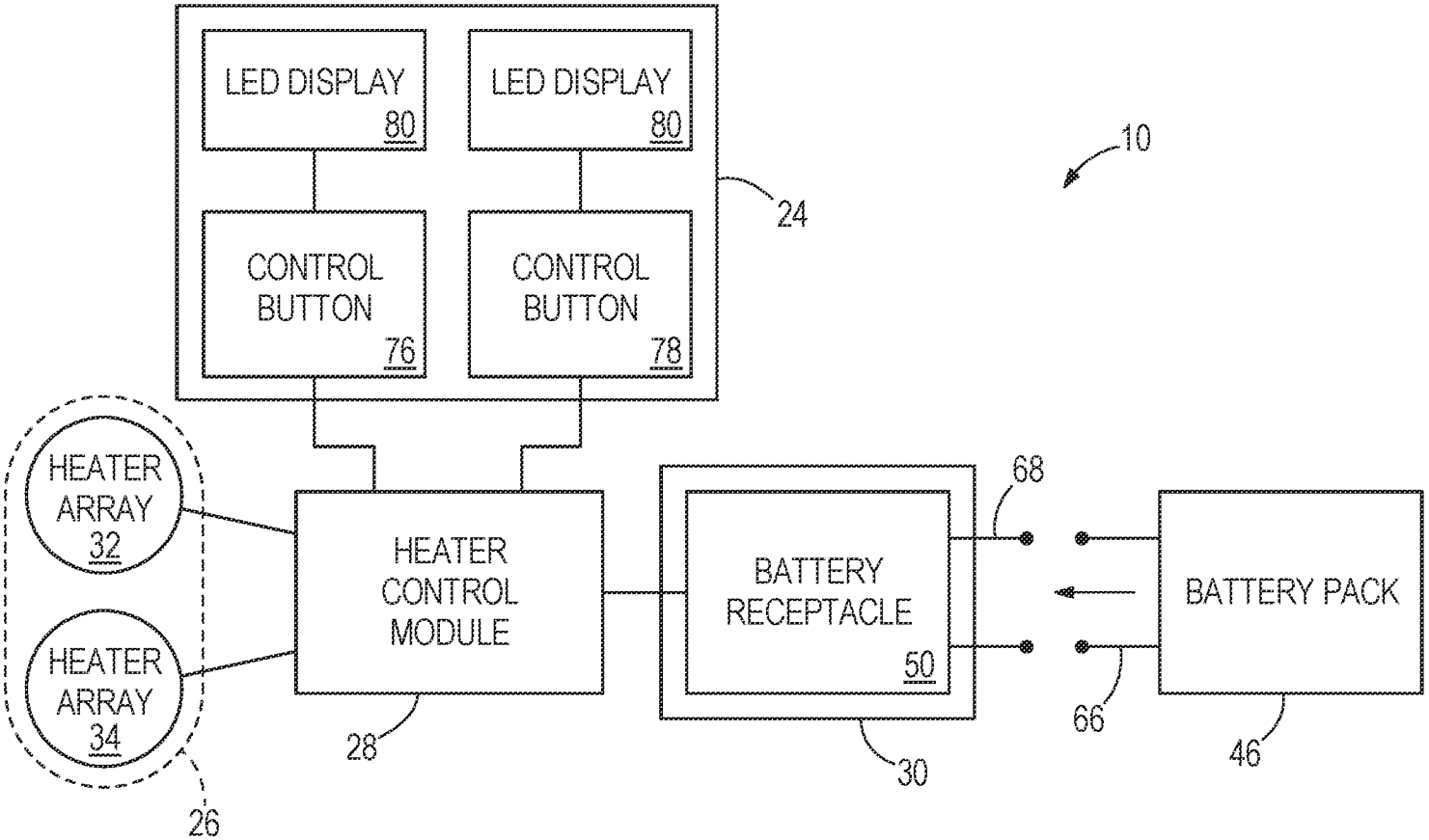
FIG. 3 is an electrical block diagram for the jacket shown in FIG. 1
Figure 4:
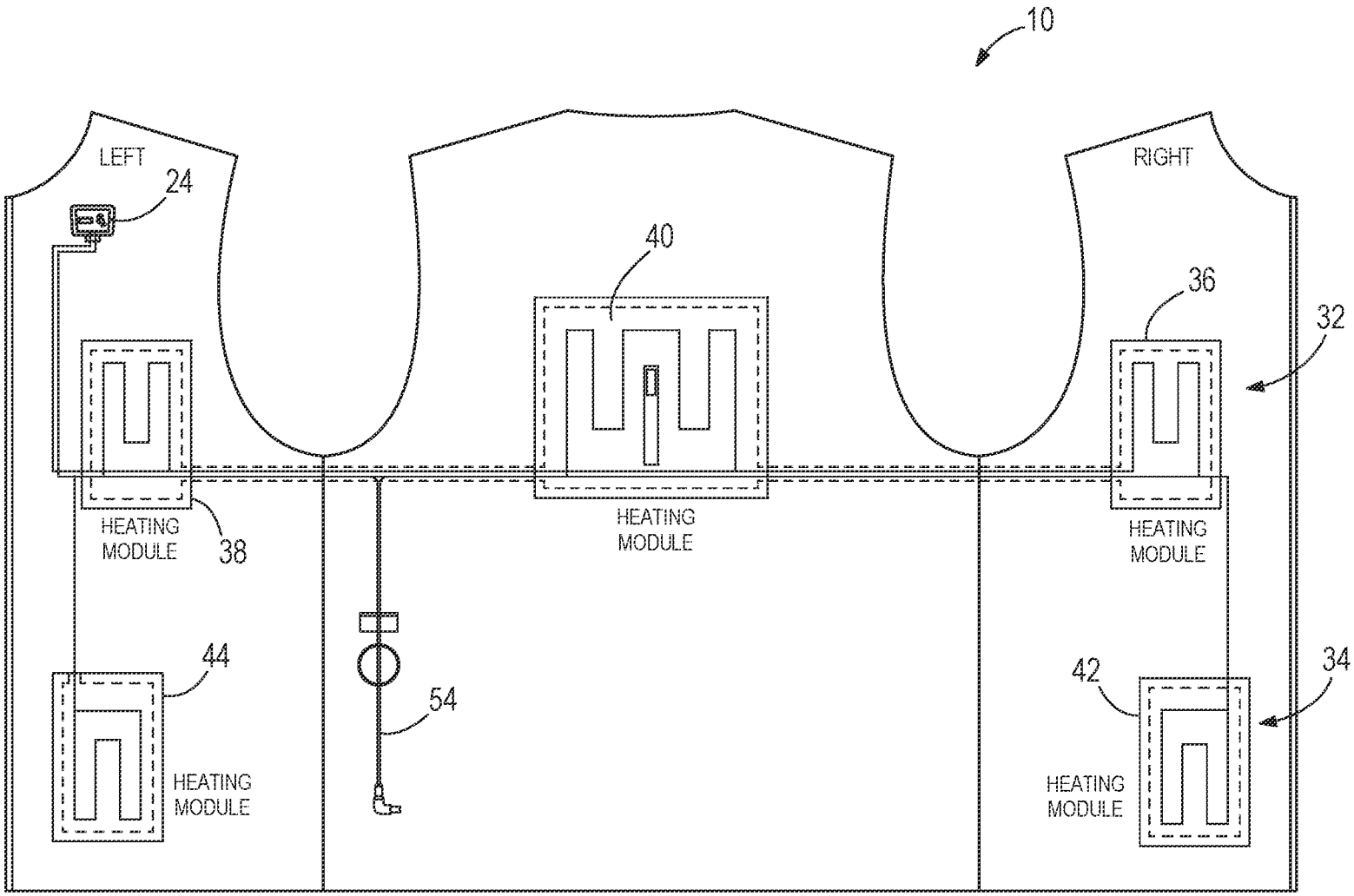
FIG. 4 is a schematic diagram of the jacket shown in FIG. 1.

As shown in FIG. 3, the illustrated jacket 10 also includes a control button assembly 24, a heating array 26, a heater control module 28, and a battery compartment 30 (FIGS. 2 and 3). The heating array 26 includes a core heating array 32 and a pocket heating array 34. As shown in FIG. 4, the core heating array 32 includes a right chest heating module 36, a left chest heating module 38, and a back heating module 40. The pocket heating array 34 includes a right pocket heating module 42 and a left pocket heating module 44. The heating arrays 32, 34 may include resistive heating coils formed of carbon fibers, high-density carbon fibers, or other heating devices.

The core heating array 32 and pocket heating array 34 are controlled via the heater control module 28 and the control button assembly 24. The user interacts with the control button assembly 24 to control operation of the heating array 26. The heating array 26 receives electrical energy from a battery pack 46 (FIG. 6-7) received in the battery compartment 30 and converts said electrical energy into heat. In other embodiments, the heating array 26 can include more or less heater modules and/or the heater modules may be positioned elsewhere throughout the jacket 10. In some embodiments, the jacket 10 includes a single heater module in the torso body 12 instead of multiple heater modules.

Figure 5:
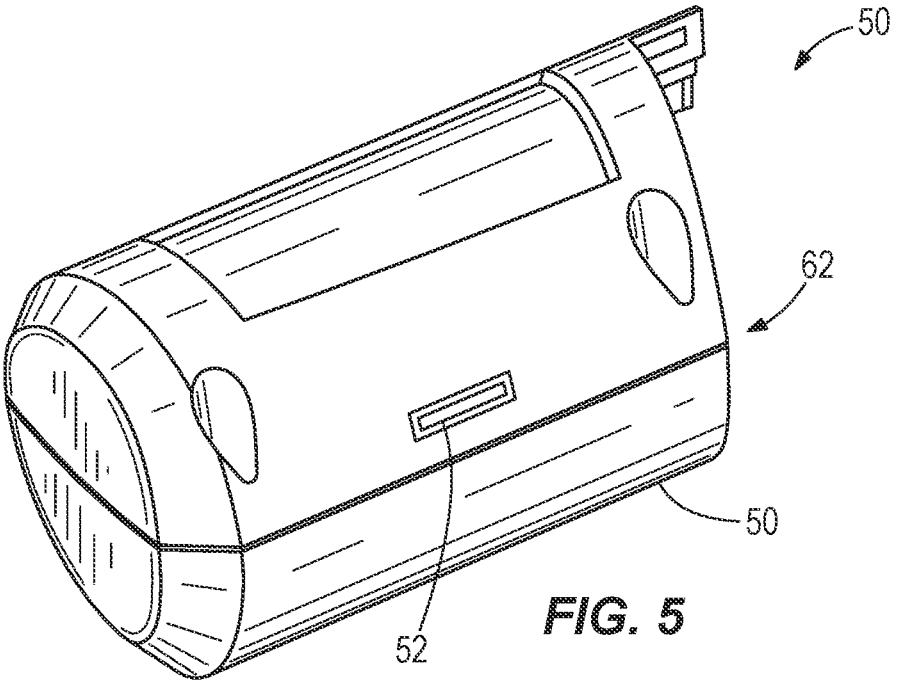
FIG. 5 is a perspective view of a battery receptacle of the jacket shown in FIG. 1.

As shown in FIG. 2, the battery compartment 30 is located on a lower portion of the back torso body. In other embodiments, the battery compartment 30 may be located elsewhere on the jacket 10. The battery compartment 30 includes a zipper 48, providing selective access by a user to the battery compartment 30 in order to access the battery pack 46 and other electrical components. The battery compartment 30 includes a battery receptacle 50 (FIG. 5) configured to receive the battery pack 46.

In the illustrated embodiment, the battery receptacle 50 also includes a USB type port 52 for communicating with and charging other electronic devices, such as a digital media player, an iPod®, a smartphone, or another similar device. The battery receptacle 50 receives electrical energy from the battery pack 46 and supplies the electrical energy to the heater control module 28 for distribution to the heating arrays 32, 34. The battery receptacle 50 transmits the electrical energy through a heater supply cable 54 (FIG. 4). The heater supply cable 54 is detachably coupled to the battery receptacle 50. In some embodiments, the battery receptacle 50 may also include a battery state-of-charge indicator including, for example, one or more LEDs.

Figure 6:
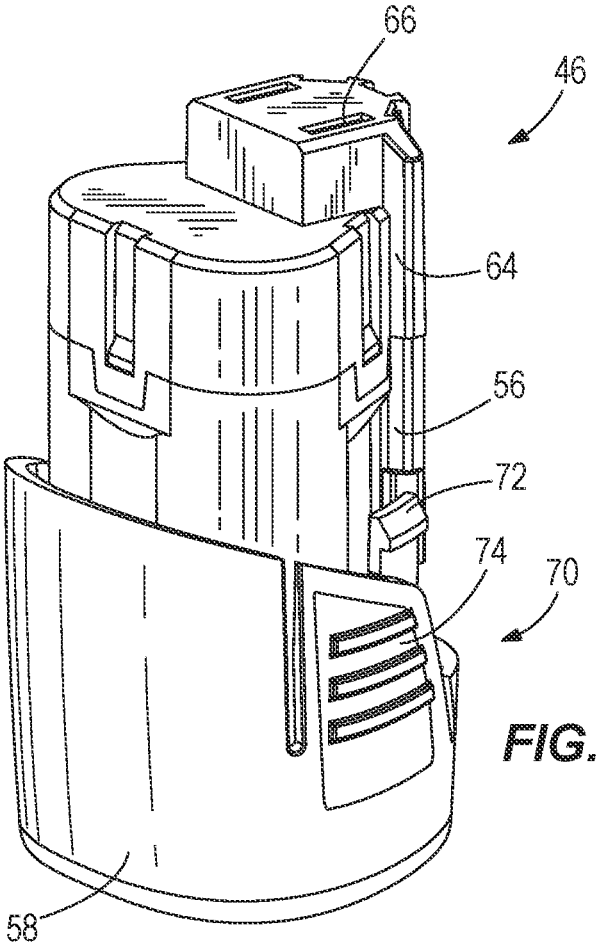
FIG. 6 is a perspective view of a battery pack for the jacket shown in FIG. 1.

In the illustrated embodiment, the battery receptacle 50 is configured to receive a battery pack, such as the battery pack 46 shown in FIG. 6. The illustrated battery pack 46 is a 12-volt lithium-based battery pack and is also operable to power other devices, such as a power tool (not shown; e.g., a drill, a pipe cutter, an impact driver, a saw, etc.), a non-motorized device (not shown; e.g., a sensing device (a camera, a sensor, a multi-meter, a scanner, etc.)), etc.

In other embodiments, the battery receptacle 50 may have a different construction to accommodate different type of battery packs (e.g., having a different voltage, chemistry, interface, etc.). For example, in some embodiments (not shown), the battery receptacle 50 may receive an 18-volt battery pack or another type of battery pack.

Figure 7:
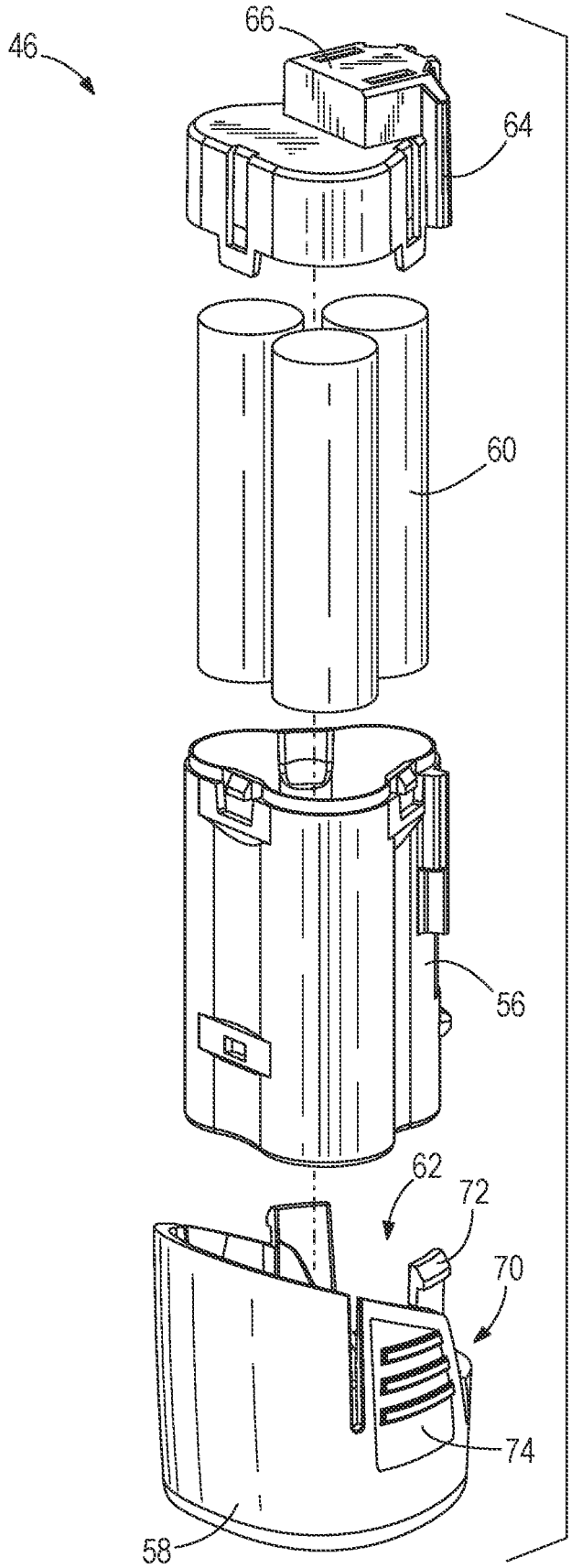
FIG. 7 is an exploded view of the battery pack shown in FIG. 6.

As illustrated in FIGS. 6-7, the battery pack 46 includes a casing 56, an outer housing 58 coupled to the casing 56, and a plurality of battery cells 60 positioned within the casing 56. The casing 56 is shaped and sized to fit within a cavity 62 of the battery receptacle 50 shown in FIG. 5 or, alternatively, in a power tool or non-motorized sensing device to connect the battery pack 46 to the tool or device. The casing 56 includes an end cap 64 to substantially enclose the battery cells 60 within the casing 56. The illustrated end cap 64 includes two power terminals 66 configured to mate with corresponding power terminals 68 (FIG. 3) extending within the cavity 62 of the battery receptacle 50. In other embodiments, the end cap 64 may also include sense or communication terminals that are configured to mate with corresponding terminals within the battery receptacle 50 or a tool.

The outer housing 58 includes a latching mechanism 70 for positively engaging the battery pack 46 with the battery receptacle 50. The latching mechanism 70 includes latching tabs 72 and resilient actuating portions 74. The latching tabs 72 are configured to engage corresponding recesses within the cavity 62 of the battery receptacle 50. The resilient actuating portions 74 are coupled to the latching tabs 72 and are configured for a user to selectively disengage the latching tabs 72 from the battery receptacle 50.

As shown in FIG. 7, the illustrated battery pack 46 includes three battery cells 60 positioned within the casing 56 and electrically coupled to the terminals 66. The battery cells 60 provide operational power (e.g., DC power) to the jacket 10 or other device (e.g., a power tool, non-motorized device, etc.). In the illustrated embodiment, the battery cells 60 are arranged in series, and each battery cell 60 has a nominal voltage of approximately four-volts (4.0V), such that the battery pack 46 has a nominal voltage of approximately twelve-volts (12V). The cells 60 also have a capacity rating of approximately 1.4 Ah.

In other embodiments (not shown), the battery pack 46 may include more or fewer battery cells 60, and the cells 60 can be arranged in series, parallel, or a serial and parallel combination. For example, the battery pack 46 can include a total of six battery cells in a parallel arrangement of two sets of three series-connected cells. The series-parallel combination of battery cells creates a battery pack having a nominal voltage of approximately 12V and a capacity rating of approximately 2.8 Ah.

In other embodiments, the battery cells 60 may have different nominal voltages, such as, for example, 3.6V, 3.8V, 4.2V, etc., and/or may have different capacity ratings, such as, for example, 1.2 Ah, 1.3 Ah, 2.0 Ah, 2.4 Ah, 2.6 Ah, 3.0 Ah, etc. In other embodiments, the battery pack 46 can have a different nominal voltage, such as, for example, 10.8V, 14.4V, etc.

In the illustrated embodiment, the battery cells 60 are lithium-ion battery cells having a chemistry of, for example, lithium-cobalt (Li—Co), lithium-manganese (Li—Mn), or Li—Mn spinel. In other embodiments, the battery cells 60 may have other suitable lithium or lithium-based chemistries. In yet other embodiments, the battery cells 60 have a non-lithium based chemistry such as, for example, nickel-based chemistry battery packs.

Referring back to FIG. 3, the heater control module 28 receives inputs from the control button assembly 24 and selectively powers the heating arrays 32, 34. The heater control module 28 is coupled to a chest portion 75 of the jacket 10 (FIG. 1). The heater control module 28 may be configured to monitor a plurality of conditions of the jacket 10 including, but not limited to, an amount of current drawn by the heating arrays 32, 34.

The heater control module 28 includes, for example, a microprocessor, microcontroller, etc., and is configured to communicate with a controller of the battery pack 46. In the illustrated embodiment, the battery controller provides information to the heater control module 28 related to a battery pack temperature and/or voltage level. The heater control module 28 and the battery controller may also include low voltage monitors and state-of-charge monitors. The monitors are used to determine whether the battery pack 46 is experiencing a low voltage condition, which may prevent proper operation of the heating arrays 32, 34 or if the battery pack 46 is in a state-of-charge that makes the battery pack 46 susceptible to being damaged. If such a low voltage condition or state-of-charge exists, the heating arrays 32, 34 are shut down or the battery pack 46 is otherwise prevented from further discharging current to prevent the battery pack from becoming further depleted and/or damaged.

The heater control module 28 receives a user input from the control button assembly 24 that specifies whether the heating arrays 32, 34 are activated and may, in some embodiments, specify particular heating modules to be activated. For example, the control button assembly 24 may be activated to turn the heating array 32, 34 on to automatically set to an initial predetermined thermal output setting. If the control button assembly 24 is already activated (e.g., pressed), the control button assembly 24 changes the operation of the heating modules 36-44. For example, the control button assembly 24 may be used for the jacket 10 to switch between a high setting, a medium setting, and low setting. The heating modules 36-44 provide a high, medium, and low thermal output, respectively. In some embodiments, when the control button assembly 24 is first activated, the jacket 10 enters a pre-heat mode. The jacket 10 may remain in the pre-heat mode for a predetermined period of time before the heater control module 28 switches the heating modules 36-44 to the medium setting. The user may at any point adjust the thermal output setting with the control button assembly 24.

Figure 8:
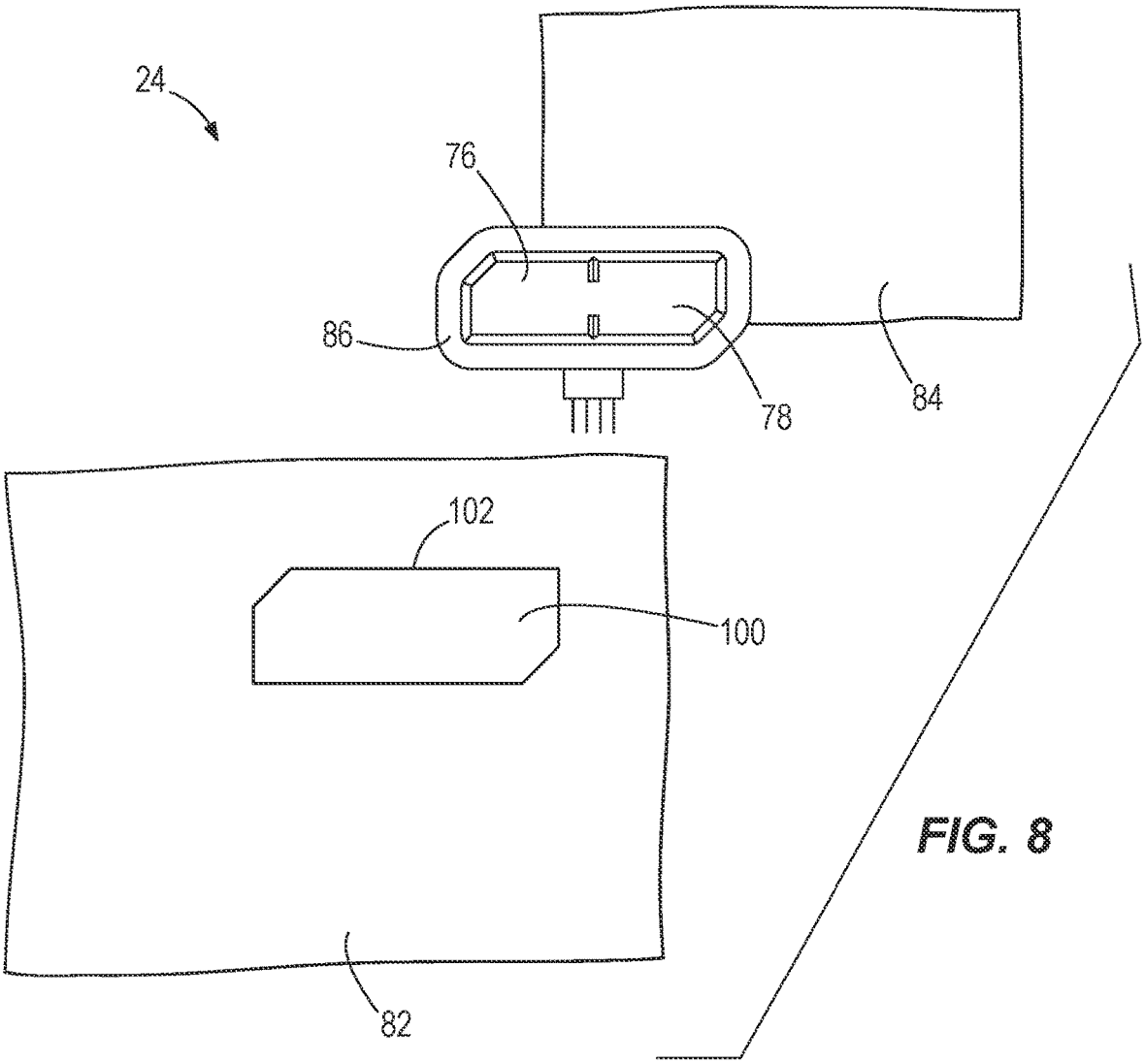
FIG. 8 is an exploded view of a control button assembly of the jacket shown in FIG. 1.
Figure 9:
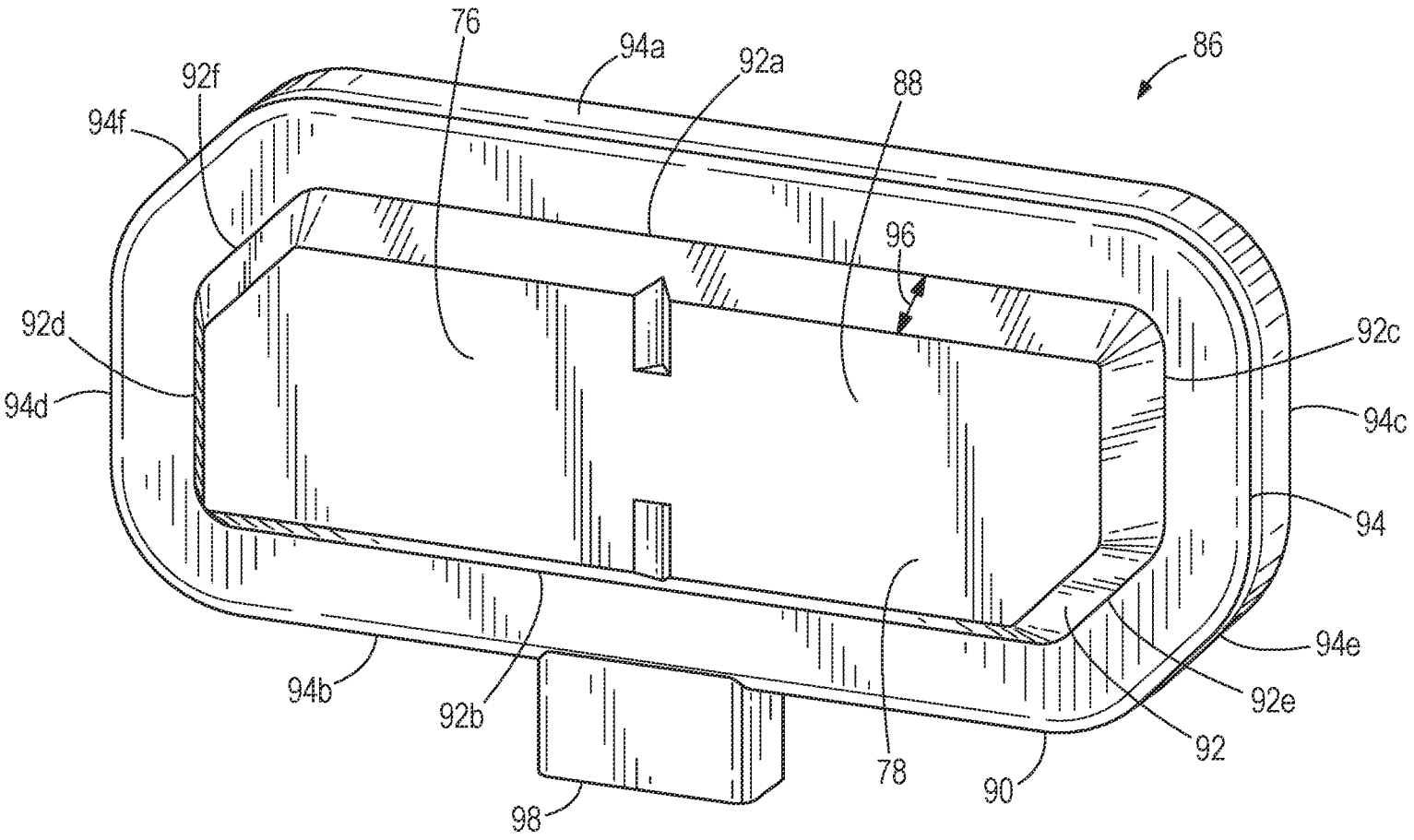
FIG. 9 is a perspective view of a control button assembly.
Figure 11:
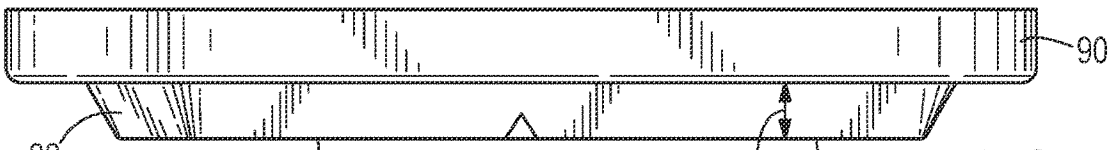
FIGS. 10-14 illustrate various views of the control button assembly shown in FIG. 9.

Referring back to FIG. 1, the illustrated control button assembly 24 is located on the front of the jacket 10. The control button assembly 24 is positioned on an upper corner of the jacket 10 to provide ease of access to the user. As shown in FIG. 8, the control button assembly 24 includes an interface 86, a display portion 80 (FIG. 3), electronics, and protective layers 82, 84. The control button assembly 24 is coupled to the heater control module 28 to provide the heater control module 28 with user input information to control the heating arrays 32, 34.

The illustrated interface 86 includes a first heater control button 76 and a second heater control button 78. In the illustrated embodiment, the first and second heater control buttons 76, 78 are push buttons for ease of use. In the illustrated embodiment, the first heater control button 76 is an on/off button for the heating modules 36-44. In the illustrated embodiment, the heating modules 36-44 turn on after the on/off button 76 is pressed and held for a designated period of time (e.g., 1.5 seconds).

Once activated the heating arrays 36-44 may, in some embodiments, be automatically set to an initial predetermined thermal output setting. In the illustrated embodiment, subsequent presses of the on/off button 76 change the thermal output setting according to a sequence (e.g., high, medium, low then back to high and so on). The on/off button 76 is configured to turn the heating modules 36-44 off after being pressed and held for designated period of time (e.g., 1.5 seconds). In other embodiments, the number of thermal output settings, the initial thermal output setting, and the sequence of thermal output settings could vary.

In the illustrated embodiment, the second heater control button 78 is a zone button to determine which heating modules 36-44 are activated. The zone button 78 controls whether the core heating array 32, the pocket heating array 34, or both heating arrays 32, 34 are turned on/off. In other embodiments, the control button assembly 24 may include more than one zone button 78. For example, the control button assembly may include a zone button 78 for each heating module 36-44 to provide more localized heating control.

As shown in FIGS. 8-14, the illustrated interface 86 generally has a rectangular shape with two opposite corners cut-out or slanted. The interface 86 includes a face 88 and a base 90. The face 88 is accessible to the user through an opening on the outer shell 20. The base 90, on the other hand, couples the interface 86 to the protective layers 82, 84 and holds the interface 86 in position.

As shown in FIGS. 9-14, the face 88 defines a face periphery 92, while the base 90 defines a base periphery 94. The base periphery 94 extends beyond the face periphery 92 on all sides to provide structural support to the face 88. As illustrated, the face periphery 92 and the base periphery 94 include six total edges, a top edge 92*a*, 94*a*, a bottom edge 92*b*, 94*b*, a right edge 92*c*, 94*c*, a left edge 92*d*, 94*d*, a lower slanted corner 92*e*, 94*e*, and an upper slanted corner 92*f*, 94*f* As also shown in FIGS. 8-13, the face 88 has a depth 96.

Figure 10:
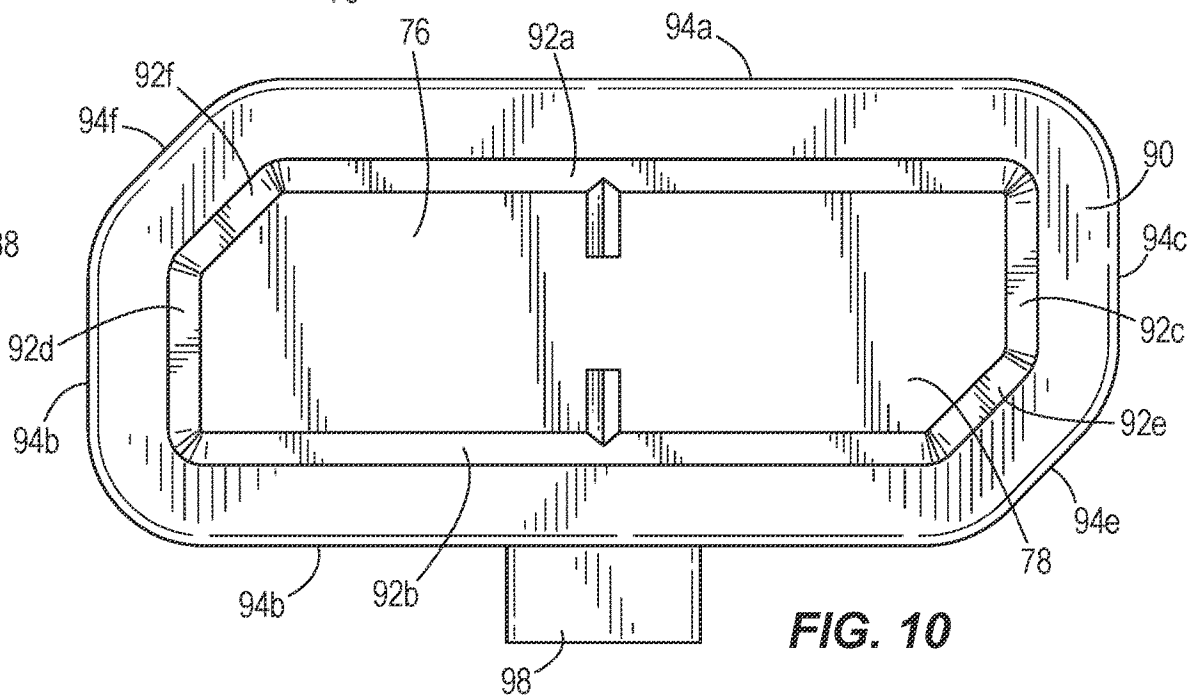
Figure 12:
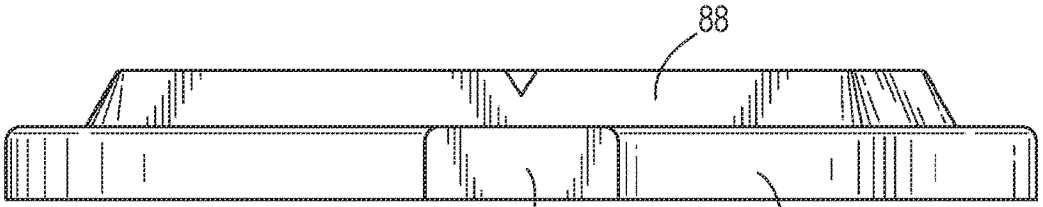
Figure 14:
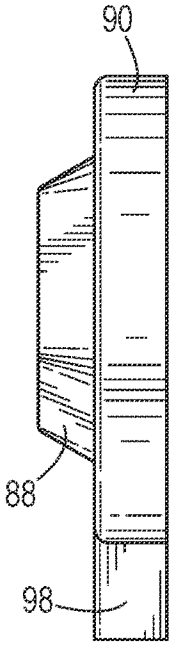
Figure 13:
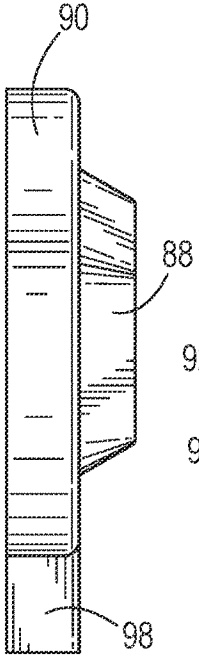

As shown in FIG. 10, an electronics protection portion 98 is coupled to the base 90. The electronics protection portion 98 protects wires that may be associated with the control buttons 76, 78, as well as other electronic components of the control button assembly 24.

The display portion 80 of the control button assembly 24 indicates a status of the heating modules 36-44. The display portion 80 may include, for example, one or more LEDs. The display portion 80 may light in different colors based on the thermal output setting of the jacket 10 and/or may indicate which heating array 32, 34 is currently activated. For example, in the pre-heat mode, the display portion 80 flashes red. At a low thermal output setting, the display portion 80 glows blue. At a medium thermal output setting, the display portion 80 glows white. At a high thermal output setting, the display portion 80 glows red.

Other embodiments may use various other colors or patterns to indicate thermal output settings. Still other embodiments may additionally or alternatively indicate other conditions, such as a state of charge of the battery pack 46. In the illustrated embodiment, the display portion 80 includes a backlight that illuminates both the on/off button 76 and the zone button 78. In other embodiments, the display portion 80 may be separate from the control button assembly 24.

Referring back to FIG. 8, the control button assembly 24 also includes the first protective layer 82 and the second protective layer 84 to cover and protect the electronics of the control button assembly 24. In the illustrated embodiments, the protective layers 82, 84 are water and dust resistant. In other embodiments, the protective layers 82 84 may be made from different types of materials (e.g., UV protective material).

As shown in FIG. 8, the interface 86 is positioned between the protective layers 82, 84. The first protective layer 82 defines an opening 100 with opening perimeter 102 of a shape complementary to (e.g., substantially the same as) the shape of the face periphery 92 of the interface 86. Because the opening perimeter 102 and the face periphery 92 have substantially the same shape, the face 88 of the interface 86 is positioned within the opening 100. The first protective layer 82 then rests on the portion of base 90 of the interface 86 that extends beyond the face periphery 92.

The second protective layer 84 is positioned on a back side of the interface 86. The second protective layer 84, however, does not include an opening. Rather, the second protective layer 84 covers the electronics associated with the interface 86. The second protective layer 84 is then connected to the first protective layer 82. The connection between the first and second protective layers 82, 84 keeps the interface 86 in place. Generally, the closer the first and second protective layers 82 84 are connected, the more securely the interface 86 is positioned within the opening 100 (e.g., because the interface 86 has less space to move). In some embodiments, the interface 86 may be secured to at least the second protective layer 84, for example, by glue, other adhesive, etc.

In the illustrated embodiments, the protective layers 82, 84 are sewn together. In other embodiments, the protective layers 82, 84 are connected differently. For example, in other embodiments, the first and second protective layers 82, 84 may be glued, stapled, clipped welded, combinations thereof, etc.

Figure 17:
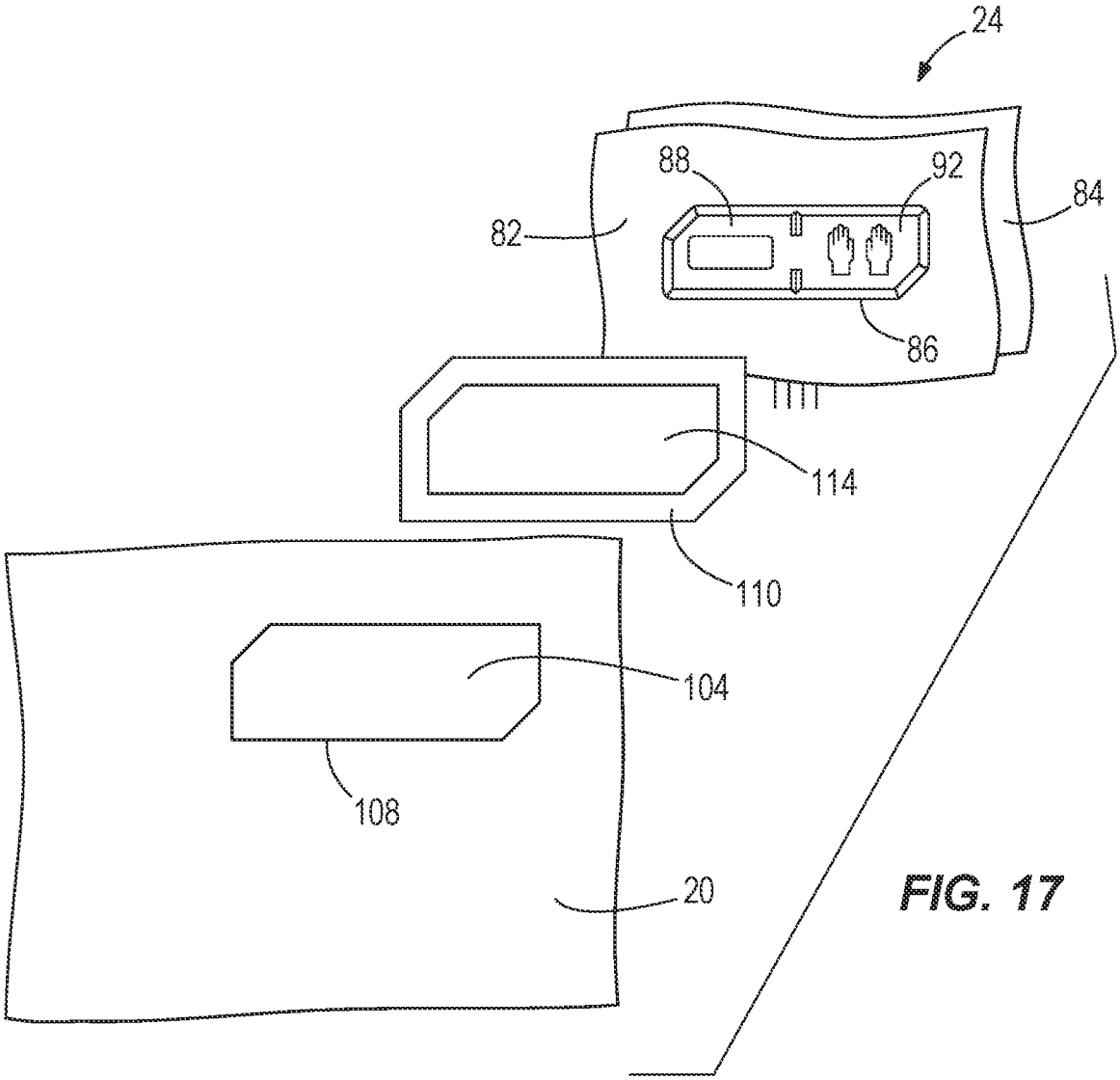
FIG. 17 is an exploded view of the assembly between the outer shell, the frame and the control button assembly shown in FIG. 13.

The control button assembly 24 is then coupled to the jacket 10 via the first protective layer 82. To make the interface 86 accessible to the user, the outer shell 20 defines a shell opening 104 (FIG. 17). The shell opening 104 includes a border 108 having a shape complementary to (e.g., substantially the same as) the shape of the face periphery 92. The face 88 of the interface 86 becomes accessible to the user through the shell opening 104, and the edges 92 of the face 88 are near and in contact with the border 108 of the shell opening 104.

The outer shell 20 and the control button assembly 24 are coupled via the first protective layer 82. In other words, the first protective layer 82 and the outer shell 20 are sewn (or otherwise joined) together. To maintain the interface 86 in a position in which the face 88 of the interface 86 is accessible through the shell opening 104, the opening 100 of the first protective layer 82 is substantially aligned with the shell opening 104. When the opening 100 of the first protective layer 82 is aligned with the shell opening 104, the face 88 of the interface 86 becomes accessible to the user.

Figure 15:
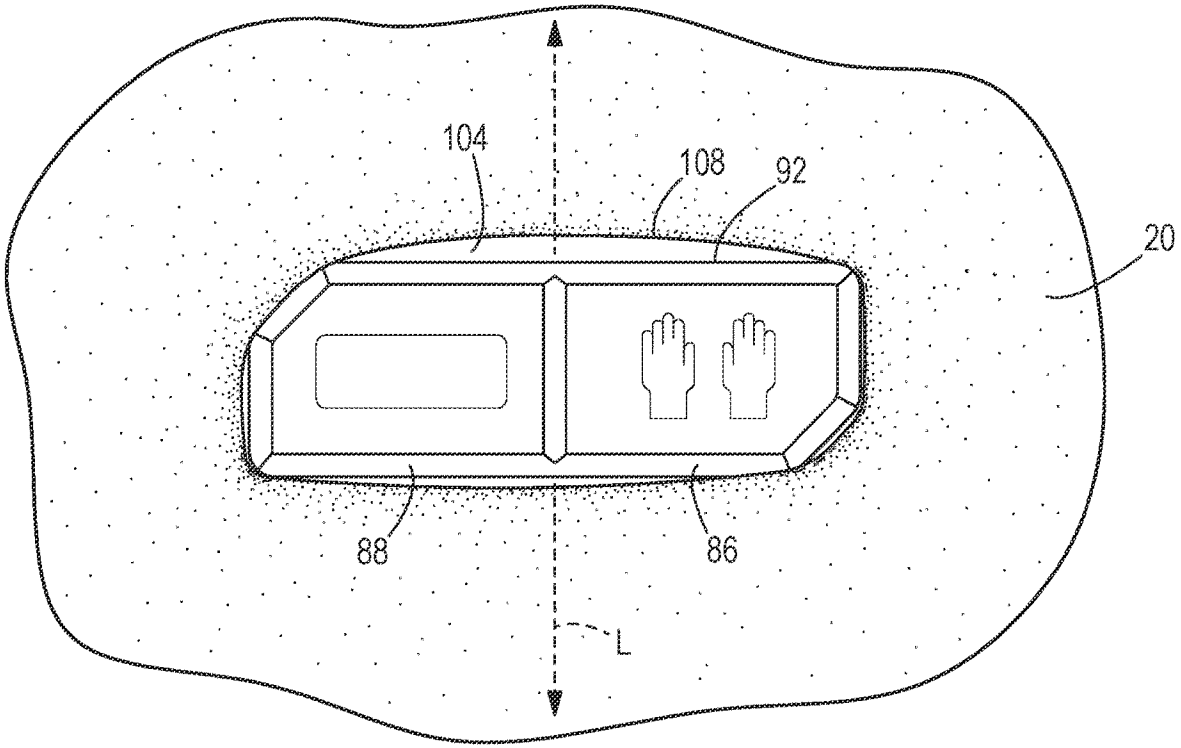
FIG. 15 illustrates an outer shell border pulling away from edges of an interface.

When a user wears the jacket 10, the user exerts a stretching force along the length of the jacket defined by a vertical axis L shown in FIG. 15. In other words, when the user wears the jacket 10 a top side (i.e., side near the collar 16) and a bottom side (i.e., near the edge of the jacket) are pulled apart, and the outer shell 20 is stretched. When the outer shell 20 is stretched, as described above, the border 108 of the shell opening 104 may pull away from the face periphery 92 of the interface 86, as shown in FIG. 15. Over time, such pulling precipitates wear on the jacket 10 and on the connection between the first protective layer 82 and the outer shell 20. In some situations, the control button assembly 24 may become detached from the outer shell 20. When the control button assembly 24 is detached from the outer shell 20, the user may have difficulty interacting with the interface 86 to control the heating arrays 32, 34. Also, the jacket 10 may be perceived as a low-quality and carelessly designed product.

Figure 16:
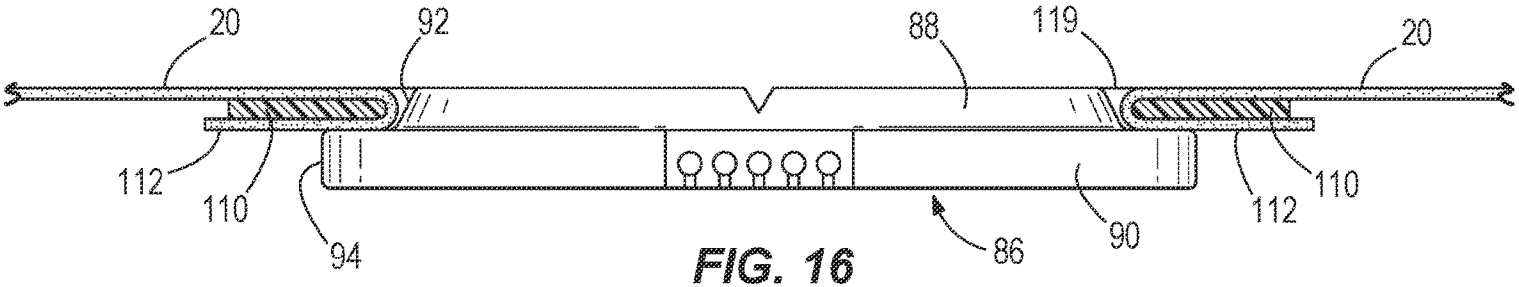
FIG. 16 is a cross-sectional view of an assembly of an outer shell, a frame and the control button assembly shown in FIG. 13.

To limit or eliminate this condition, in the embodiment shown in FIG. 16, a rigid frame 110 is positioned between the control button assembly 24 and the outer shell 20. The frame 110 may inhibit the border 108 from pulling away from the face periphery 92 of the interface 86. As shown in FIG. 16, a portion 112 of the outer shell 20 folds over the frame 110 and is in contact with the base 90 of the interface 86 (i.e., the frame 110 is positioned between a first outer portion of the outer shell 20 and a second portion 112 of the outer shell 20). In some embodiments, the outer shell 20 may not be in direct contact with the base 90 (e.g., a separate piece may be placed between the outer shell 20 and the base 90. Nevertheless, the base 90 of the interface 86 is positioned beneath the outer shell 20 and beneath the frame 110. The portion 112 of the outer shell 20 is also joined with the first protective layer 82. The frame 110 holds the outer shell border 108 close to the face periphery 92, thereby preventing the outer shell 20 from pulling away, even when a stretching force is exerted on the jacket 10.

When fully assembled, the interface 86 creates a generally planar surface 119 with the outer shell 20, which can be more clearly seen in FIG. 16. The thickness of the face 88 is substantially equal to the thickness of the frame 110 and the folded layers of the outer shell 20.

FIG. 17 illustrates the general placement of the outer shell 20, the frame 110, and the control button assembly 24. For illustrative purposes, the outer shell 20 is not shown to be joined to the first protective layer 82. However, the outer shell 20 remains joined (e.g., sewn together) with the first protective layer 82.

The illustrated frame 110 is made from a generally rigid material to withstand the stretching force on the jacket 10. The frame 110 defines a frame opening 114. The frame opening 114 has a shape complementary to (e.g., substantially the same as) the perimeter shape of the interface 86 and allows the face 88 to be accessible through the frame opening 114. In the illustrated embodiment, the frame opening 114 outlines the same polygonal shape of the face 88 of the interface 86. In particular, the illustrated frame opening 114 includes edges mostly forming a rectangular shape with an upper slanted corner and a lower slanted corner.

Referring back to FIG. 16, the frame 110 extends beyond the base periphery 94 of the interface 86, thus providing more support for the outer shell 20. In the illustrated embodiment, the frame 110 extends beyond the base periphery 94 of the interface 86 on all edges 94*a-f* In the illustrated embodiment, however, the frame 110 does not extend beyond the electronics protection portion 98 of the interface 86. In other embodiments (not shown), the frame 110 may extend beyond fewer than all edges of the base periphery 94 (e.g., beyond one, two, three, or more edges). In other embodiments (not shown), the frame 110 can additionally extend beyond the electronics protection portion 98.

The frame 110 is positioned between the control button assembly 24 and the outer shell 20. When assembling the jacket 10 and, in particular, when positioning the interface 86 to be accessible by the user, the frame opening 114 becomes substantially aligned with the opening 100 of the first protective layer 82, and with the shell opening 104. The frame opening 114, the opening 100 of the first protective layer 82, and the shell opening 104 are approximately the same size and are sized to tightly accommodate the face 88 of the interface 86.

In the illustrated embodiments, the frame 110 is not permanently attached to the outer shell 20 or to the control button assembly 24. In other words, the frame 110 is not fastened to the outer shell 20 or to the control button assembly 24. Rather, the frame 110 is held in place by the attachment between the outer shell 20 and the control button assembly 24. The frame 110 fits in the space between the outer shell 20 and the control button assembly 24. Because the outer shell 20 and the first protective layer 82 are joined (e.g., sewn together), the frame 110 does not shift or move. The frame 110 does not become disassembled because the frame opening 114 does not accommodate the control button assembly 24 and because the stretching force on the jacket 10 prevents the frame 110 from moving excessively.

The inner shell 22, as discussed above, is coupled to the outer shell 20. The inner shell 22 covers the inside of the control button assembly 24, such that the face 88 of the interface 86 but not the electronic components for the control button assembly 24 are visible.

Figure 18:
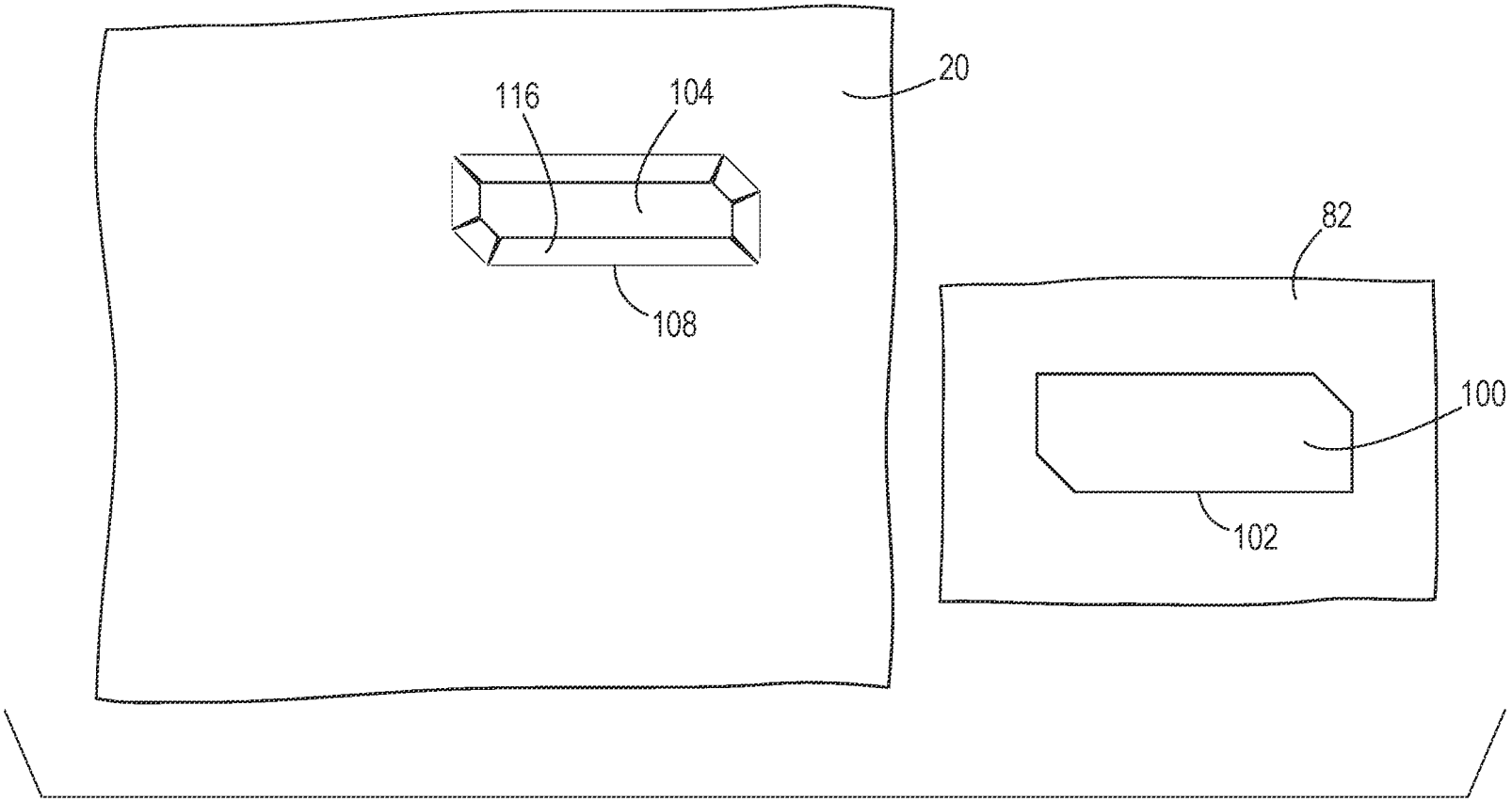
FIGS. 18-22 illustrate a method of assembling an outer shell, a frame, and a control button assembly.

FIGS. 18-26 illustrate methods for assembling the jacket 10 with the frame 110 and the control button assembly 24. FIG. 18 illustrates a portion of the outer shell 20 and the first protective layer 82. The portion of the outer shell 20 defines the shell opening 104. The first protective layer 82 includes the opening 100.

Figure 19A:
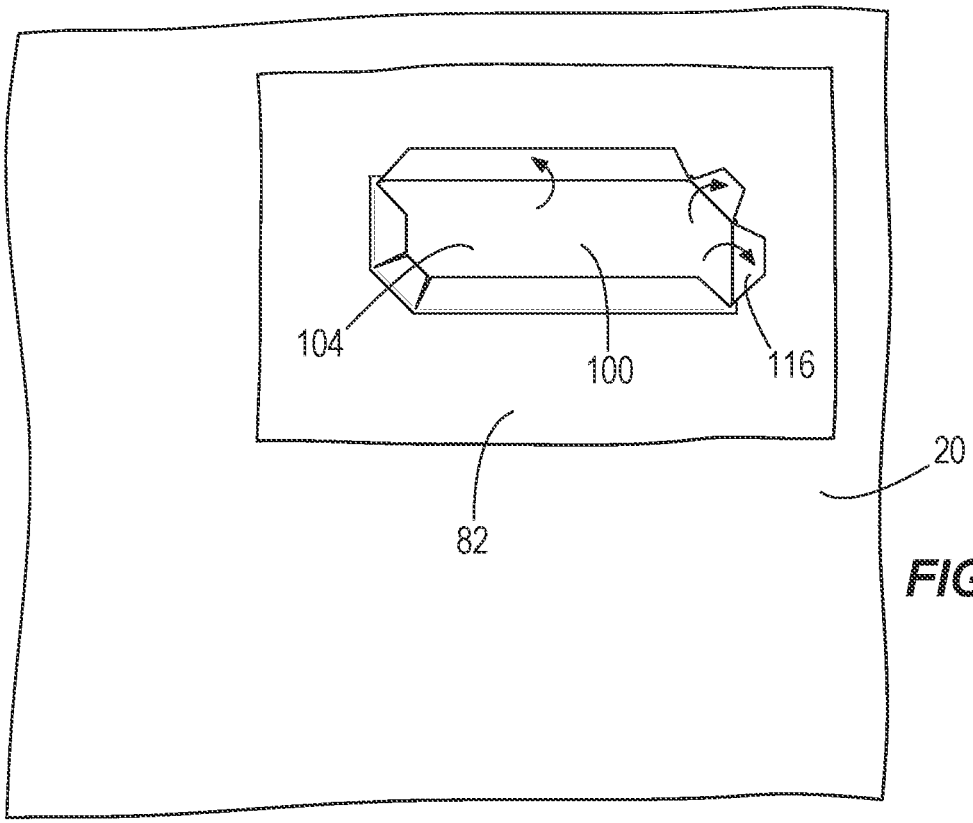
Figure 19B:
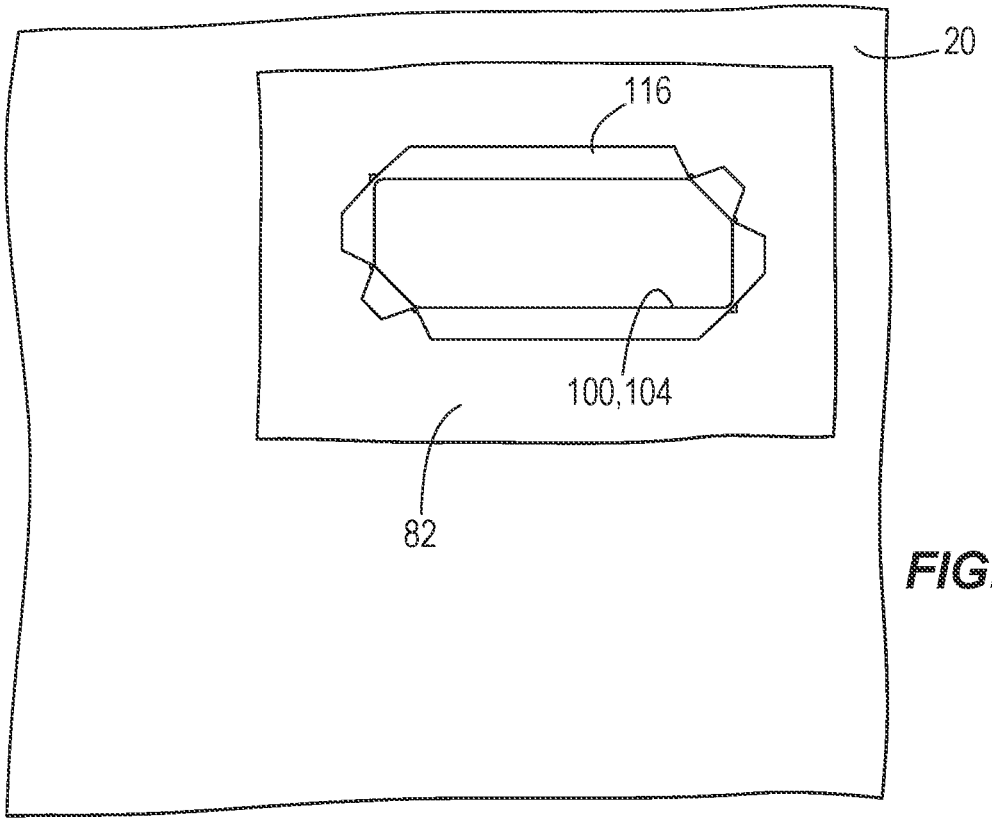

As shown in FIGS. 18-19B, the outer shell 20 also includes sewing edges 116 defining the shell opening 104. As shown in FIG. 19A, the shell opening 104 and the opening 100 of the first protective layer 82 are aligned, and the sewing edges 116 of the outer shell 20 are folded inwardly toward the first protective layer 82. FIG. 19B shows the sewing edges 116 folded inwardly and attached to the first protective layer 82 and the shape of the opening of the first protective layer 82 and the shell opening 104. As previously discussed, the shape of the openings 100, 104, 114 is substantially the same as and follows the shape of the face periphery 92 of the interface 86.

Figure 20:
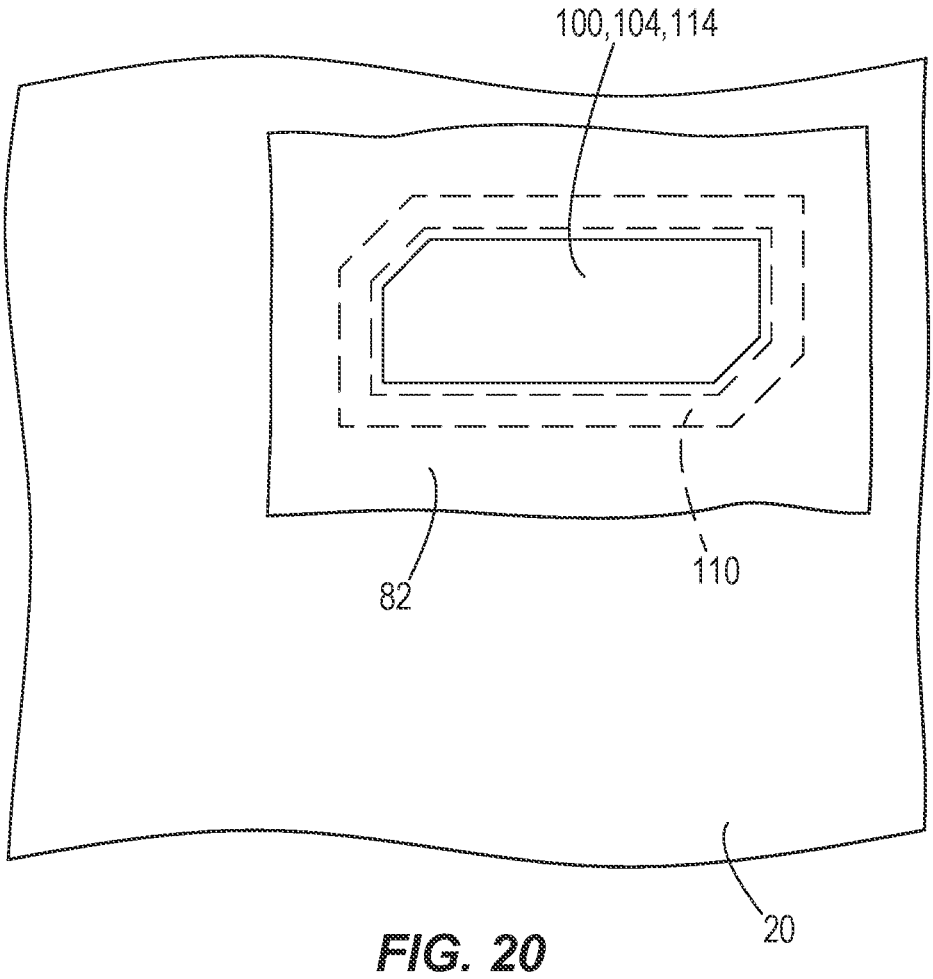

As shown in FIG. 20, in some embodiments, the frame 110 is added once the first protective layer 82 and the outer shell 20 have been joined. In the illustrated embodiment, the frame 110 is added by passing the first protective layer 82 through the frame opening 114. Passing the first protective layer 82 through the frame opening 114 aligns the frame opening 114 with the opening 100 of the first protective layer 82 and with the shell opening 104. Therefore, the openings 100, 104, 114 define an area to receive the face 88 of the interface 86. Once the first protective layer 82 is passed through the frame opening 114, the frame 110 is positioned between the outer shell 20 and the first protective layer 82. FIG. 20 illustrates the frame 110 already in position (i.e., between the outer shell 20 and the first protective layer 82) in phantom. In the illustrated embodiment, the frame opening 114 is slightly larger than the shell opening 104 and the opening 100 of the first protective layer 82 to accommodate the thickness of the first protective layer 82 and/or the outer shell 20 between the face periphery 92 and the frame opening 114.

Figure 21A:
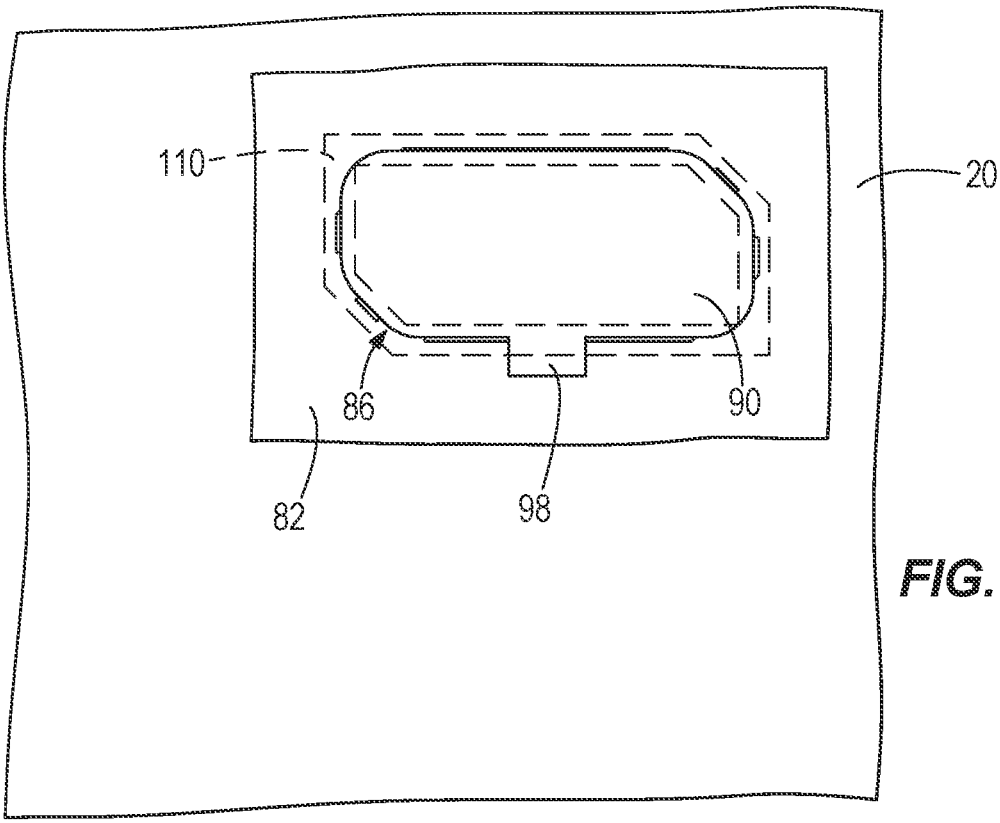
Figure 21B:
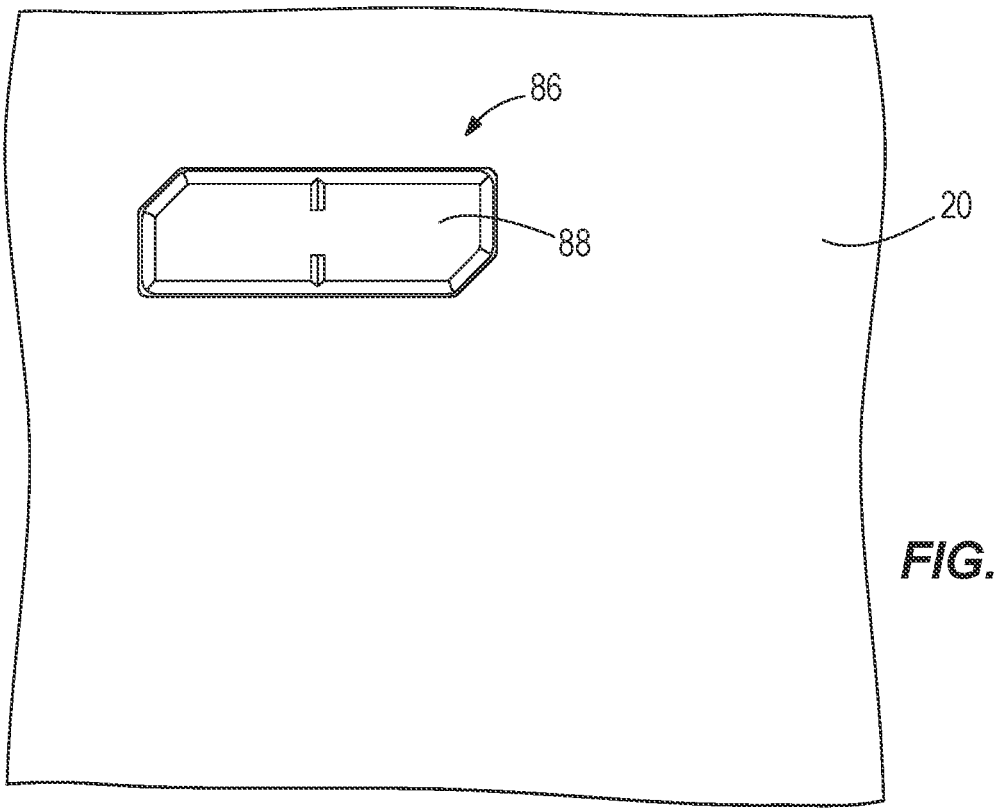

Once the first protective layer 82 and the outer shell 20 are joined by, for example, sewing the two fabrics together, and the frame 110 is installed, the interface 86 is positioned such that the face 88 of the interface 86 is accessible through the shell opening 104. FIG. 21A illustrates the back side (or inside side) when the interface 86 is positioned in the jacket 10. As shown in FIG. 21A, the frame 110 extends beyond the base periphery 94 of the interface 86. FIG. 21B illustrates the front side (or outside side) of the jacket 10 once the interface 86 has been placed appropriately. As seen in FIG. 21B, the face 88 of the interface 86 is accessible through the shell opening 104 while the base 90 of the interface 86 provides support for the face 88.

Figure 22:
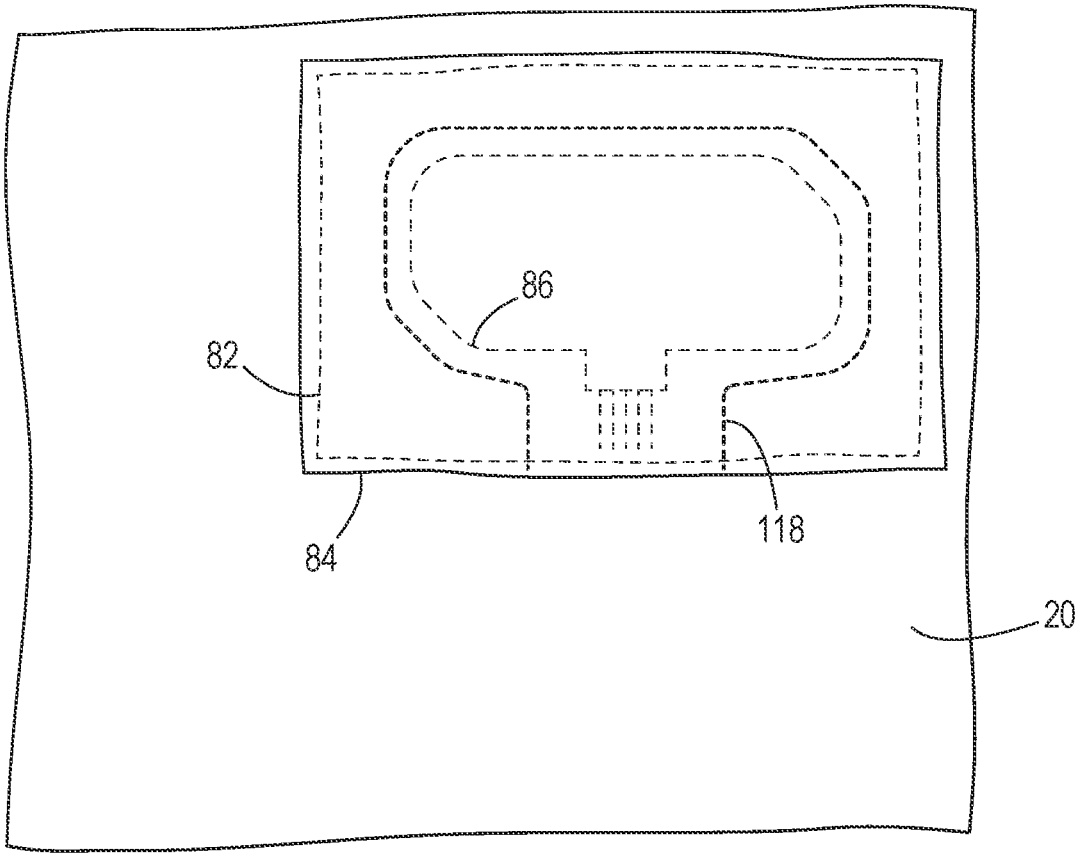

After the interface 86 has been positioned with the face 88 accessible through openings 100, 104, 114, the second protective layer 84 is added to the control button assembly 24. As shown in FIG. 22, the second protective layer 84 is placed on the back side of the interface 86 and is sewn (or otherwise joined) to the first protective layer 82 as shown by the illustrated sew lines 118. The interface 86 and the first protective layer 82 are shown in phantom to show the relationship between the first protective layer 82, the interface 86, and the second protective layer 84. As shown in FIG. 22, the second protective layer 84 leaves an open portion toward the bottom of the interface 86 to accommodate any wires associated with the interface 86.

Figure 23:
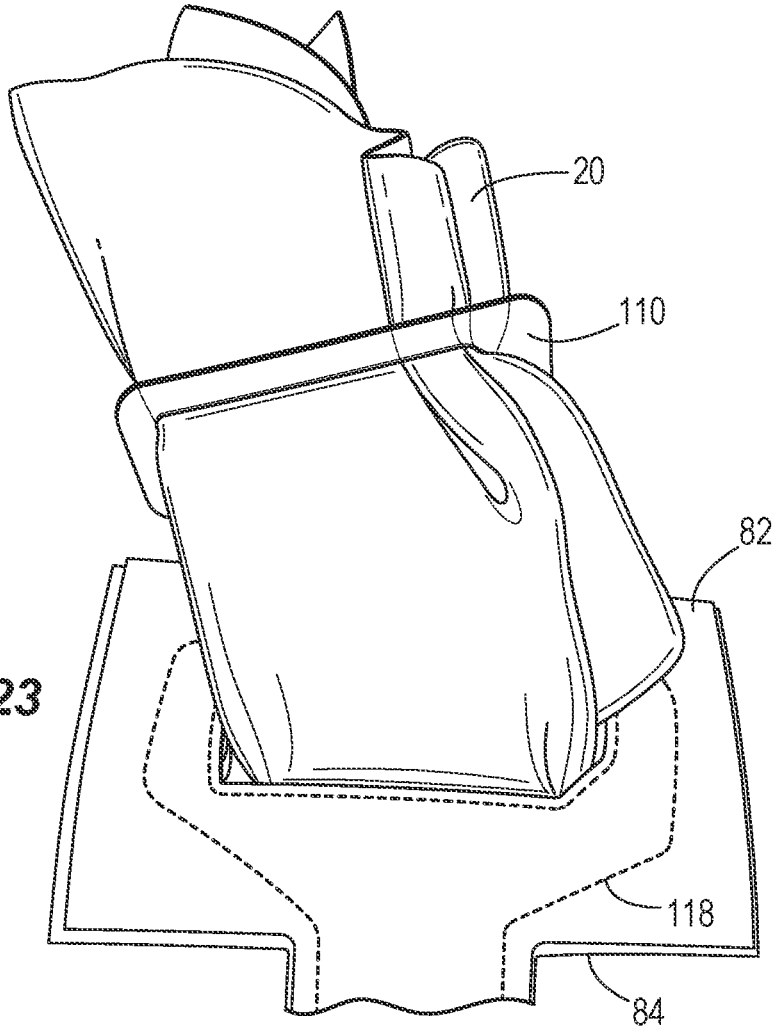
FIGS. 23-25 illustrate another method of assembling an outer shell, a frame, and a control button assembly.
Figure 24:
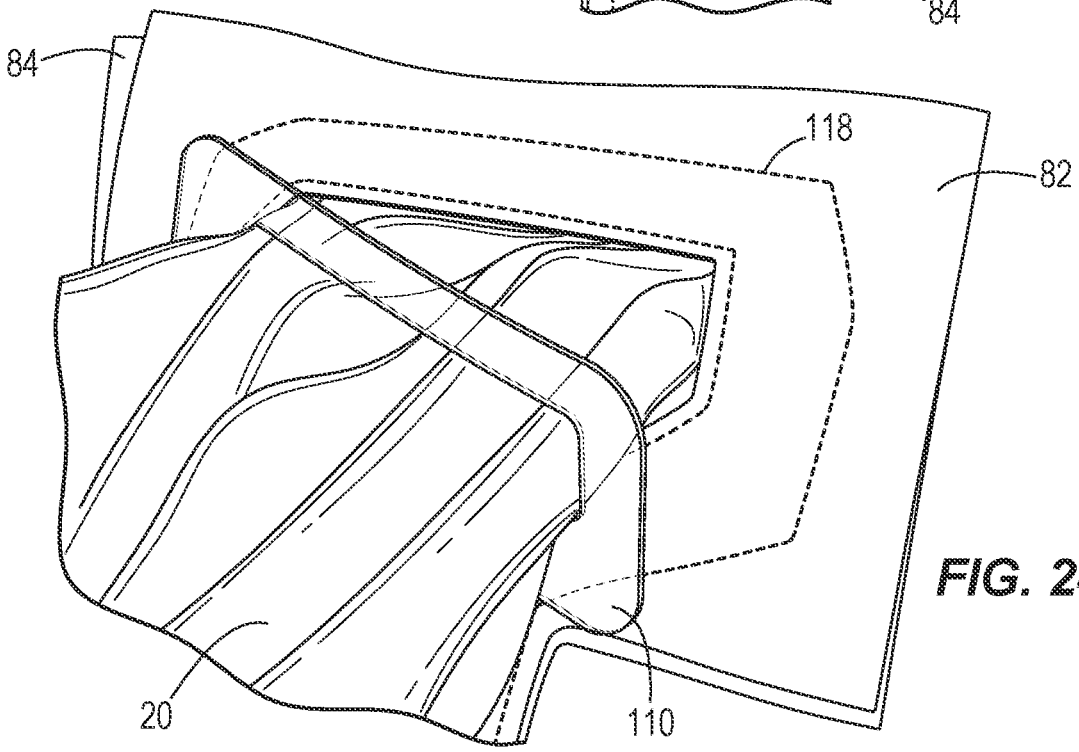
Figure 25:
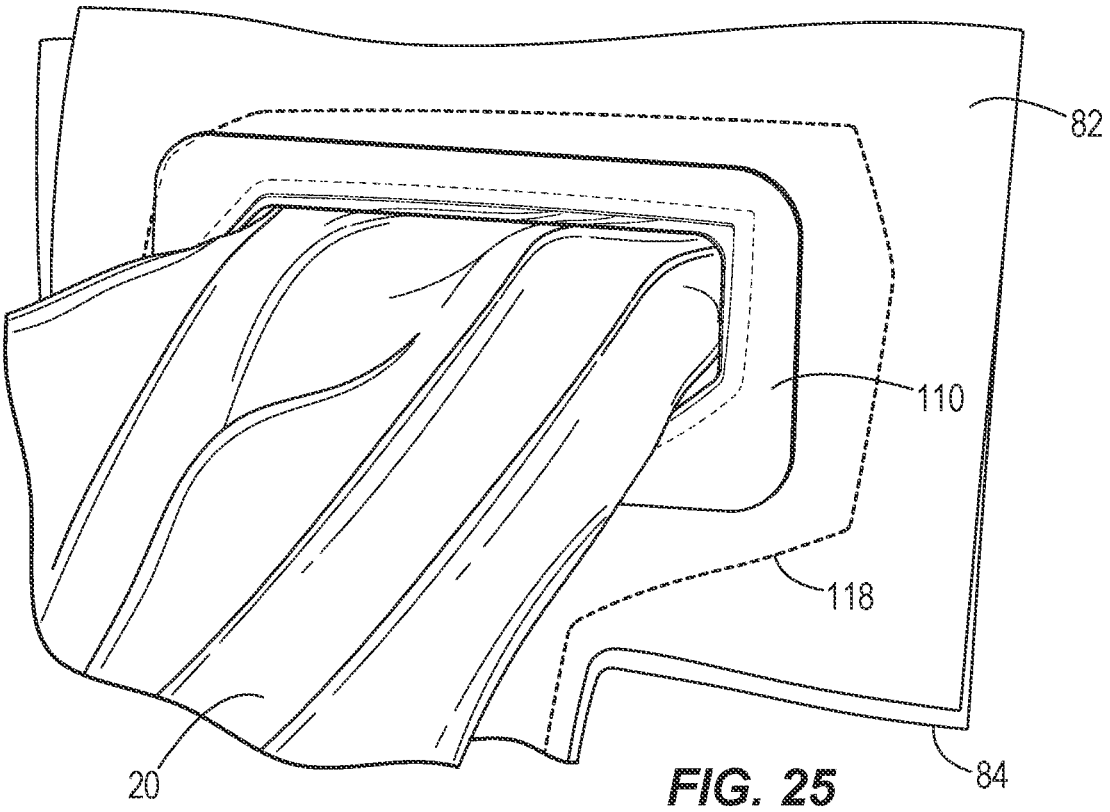

FIGS. 23-26 illustrate another method of assembling the jacket 10 in which the frame 110 is added later in the process. As shown in FIGS. 23-24, the outer shell 20 is first connected to the first protective layer 82 and is then passed through the frame opening 114 until the openings 100, 104, 114 are aligned. In some embodiments, the outer shell 20 is formed in panels before assembly of the jacket 10, such that only a portion of the outer shell 20 (e.g., a panel) is passed through the frame opening 114. FIG. 25 illustrates the final placement of the frame 110 between the outer shell 20 and the control button assembly 24 (e.g., the first protective layer 82). FIG. 25 also illustrates the position of the frame 110 if it would have been incorporated as shown in FIG. 19, and after the control button assembly 24 has been assembled.

Figure 26:
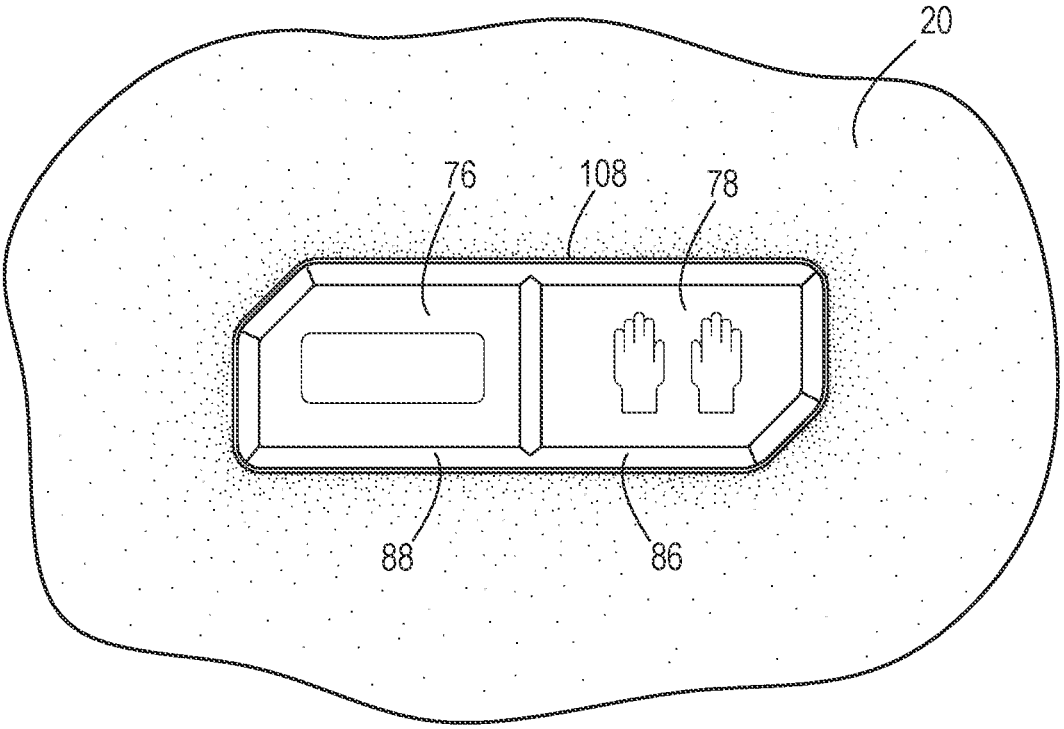
FIG. 26 illustrates an outer shell border being held in place by a frame.

As shown in FIG. 26, the outer shell 20 is then folded over the frame 110. FIG. 26 illustrates the outer shell 20 and the face 88 of the interface 86 positioned within the aligned openings 100, 104, 114. As shown in FIG. 26, the border 108 of the shell opening 104 does not pull away from the edges of the face periphery 92, thereby limiting or eliminating the condition illustrated in FIG. 15.

FIGS. 28-35 illustrate alternative methods of limiting or eliminating the condition illustrated in FIG. 15. These alternative method(s) can be applied individually, or in combination with one or more other methods described with respect to FIGS. 18-26 and 28-35 and with or without the frame 110.

Figure 28:
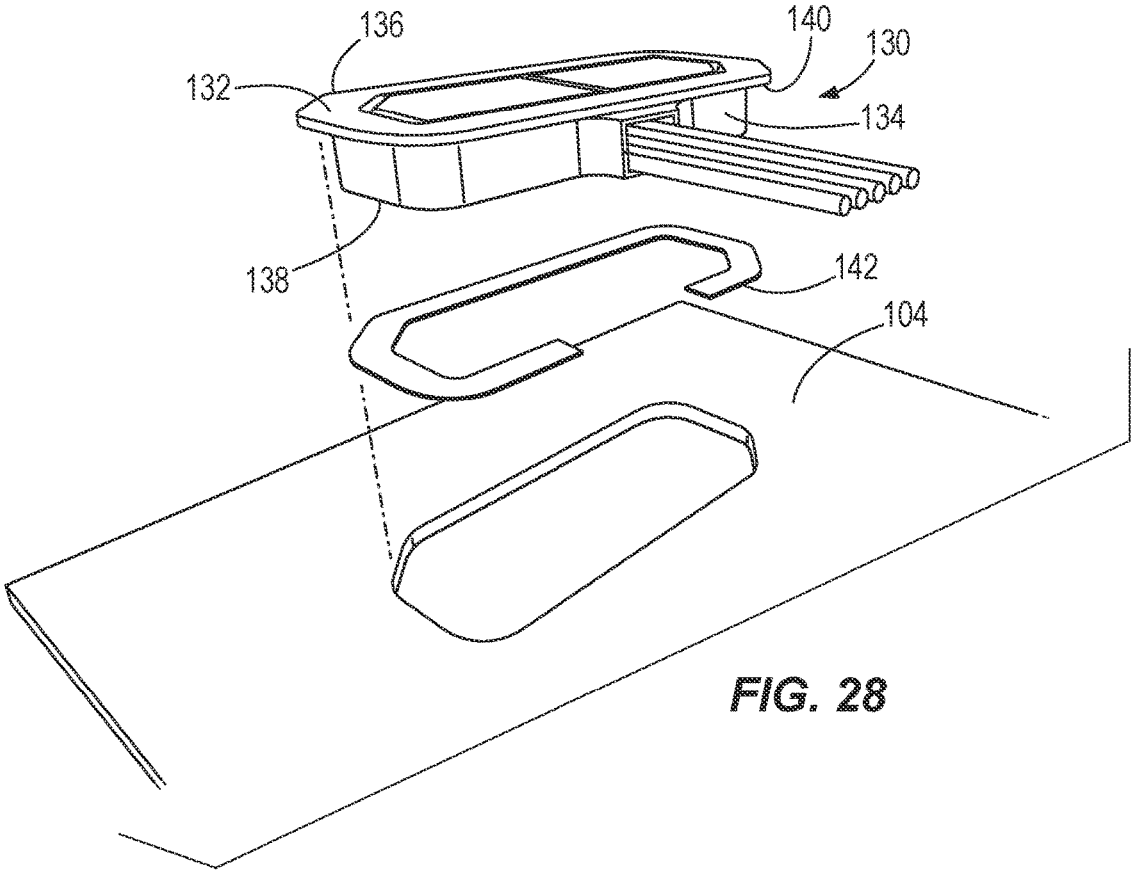
FIG. 28 illustrates another method of assembling a jacket.

FIG. 28 illustrates another construction for an interface 130 of the jacket 10 and another assembly method. As shown in FIG. 28, the interface 130 includes a face 132 and a base 134. The face 132 defines a face periphery 136 and the base 134 defines a base periphery 138. In the illustrated embodiment, the face periphery 136 extends beyond the base periphery 138 creating a shoulder 140 on the backside of the interface 130. The face periphery 136 provides an integrated flange for the interface 130. Due to the construction of the interface 130, the face 132 is placed outside the shell opening 104, although the electronic components remain located inside the jacket 10.

Figure 29:
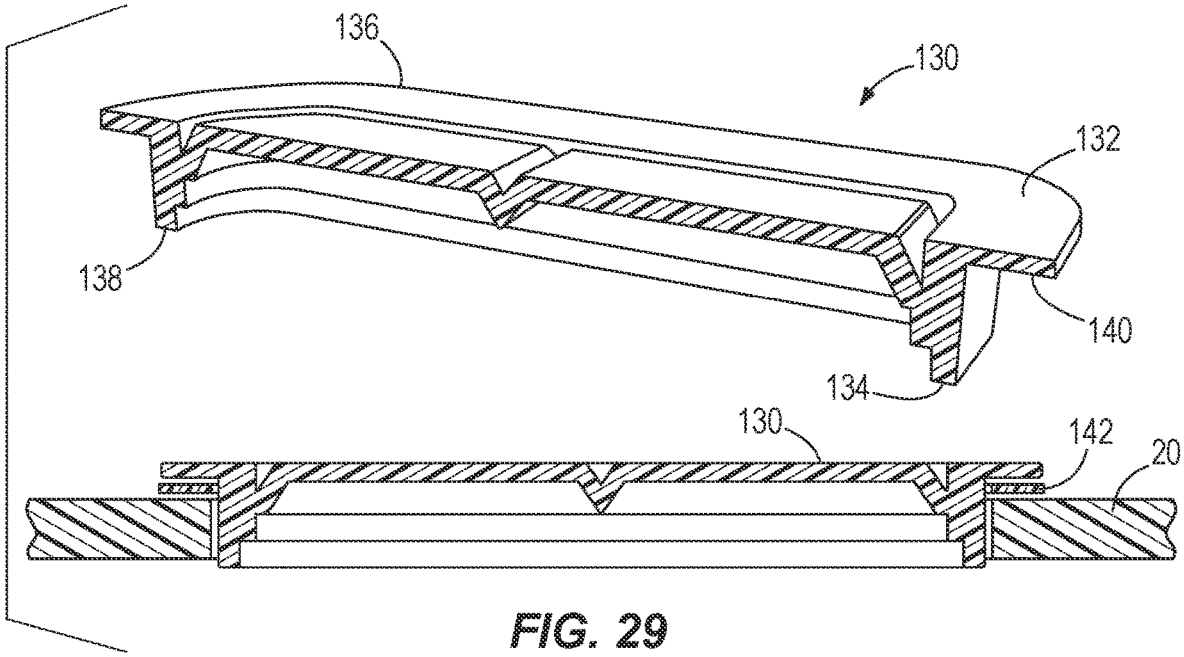
FIG. 29 is a cross-section view of an assembly the outer shell and the control button assembly shown in FIG. 28.

As shown in FIG. 28, an adhesive film 142 is applied between the shoulder 140 of the interface 130 and the outer shell 20. The adhesive film 142 is formed (e.g., laser cut, stamped, etc.) to follow the shape of the shoulder 140 of the interface 130. FIG. 29 shows the assembled interface 130 and the outer shell 20, with the adhesive film 142 positioned between the interface 130 and the outer shell 20.

Figure 30:
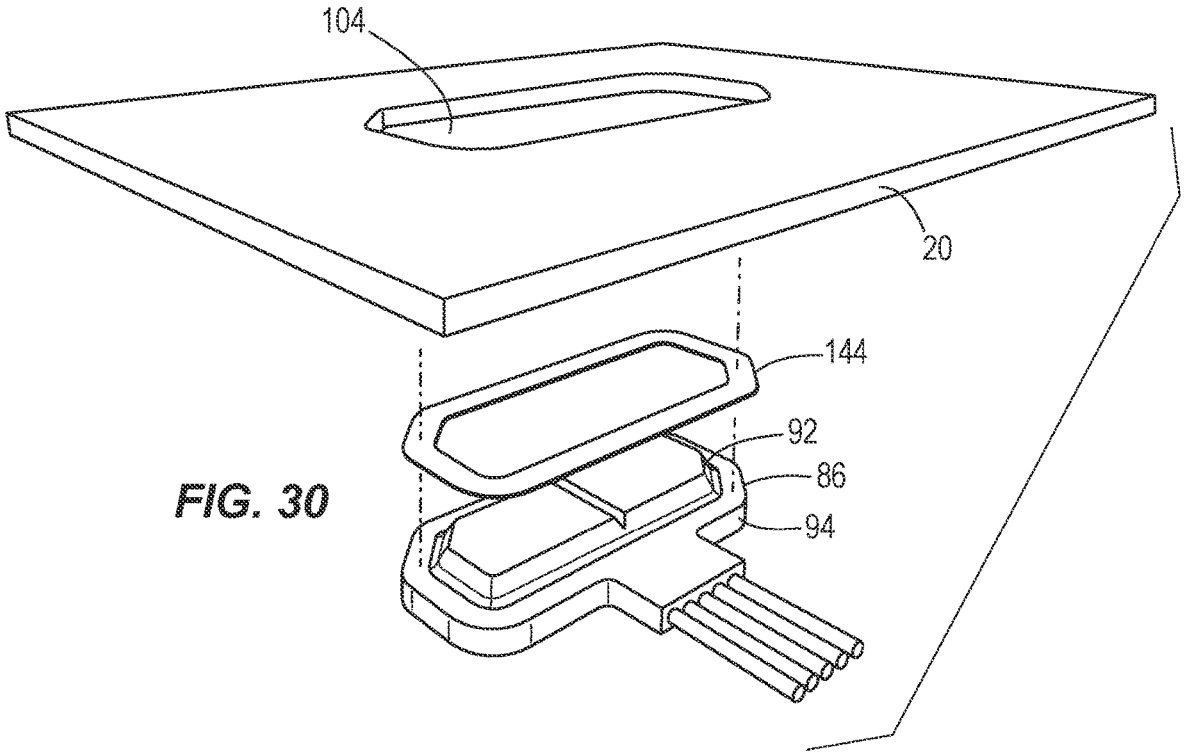
FIG. 30 illustrates yet another method of assembling a jacket.
Figure 31:
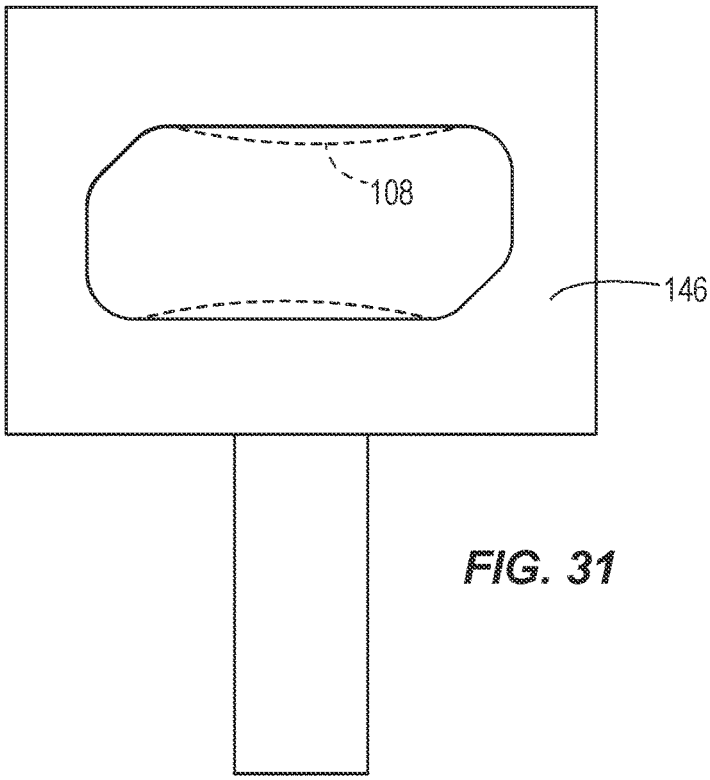
FIG. 31 illustrates a further method of assembling a jacket.

FIG. 30 illustrates another assembly method, and, as shown in FIG. 30, instead of the frame 110, an adhesive film 144 is positioned in the area between the face periphery 92 and the base periphery 94. The adhesive film 144 is formed (e.g., laser cut, stamped, etc.) to follow the shape of the interface 86 and is applied to secure the interface 86 to the outer shell 20. Although not explicitly shown in FIG. 30, the first protective layer 82 may be positioned between the adhesive film 144 and interface 86. The adhesive film 144 then holds the interface 86 to the outer shell 20.

In another alternative method (see FIG. 31), the shape of the shell opening 104 may be changed, e.g., to compensate for the pulling on the outer shell 20, to fit more tightly to the interface 86, etc. As shown in FIG. 30, the border 108, at the top and bottom, is smaller than the actual size of the face 88 of the interface 86. By making the border 108 slightly smaller, the face 88 of the interface 86 is more tightly secured in place. Furthermore, the illustrated control button assembly 24 also includes a wire support 146 for the interface 86.

Figure 32:
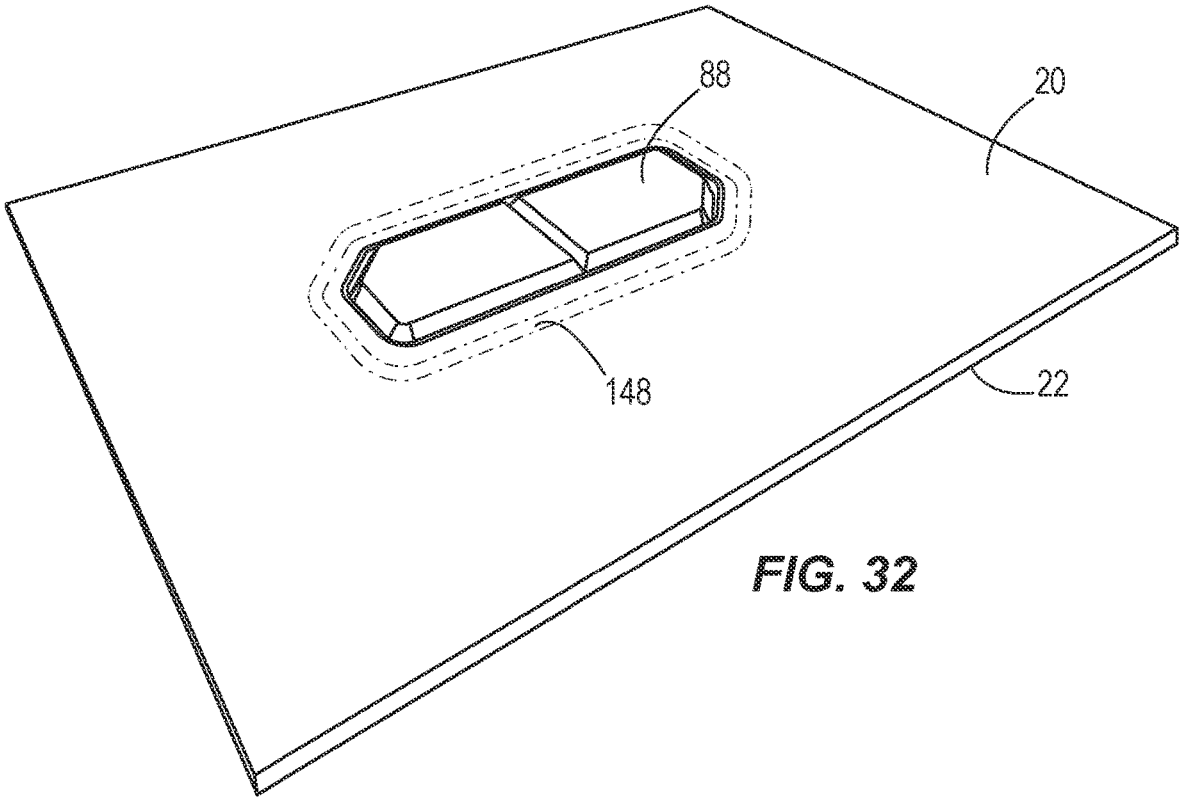
FIG. 32 illustrates another method of assembling a jacket.
Figure 33:
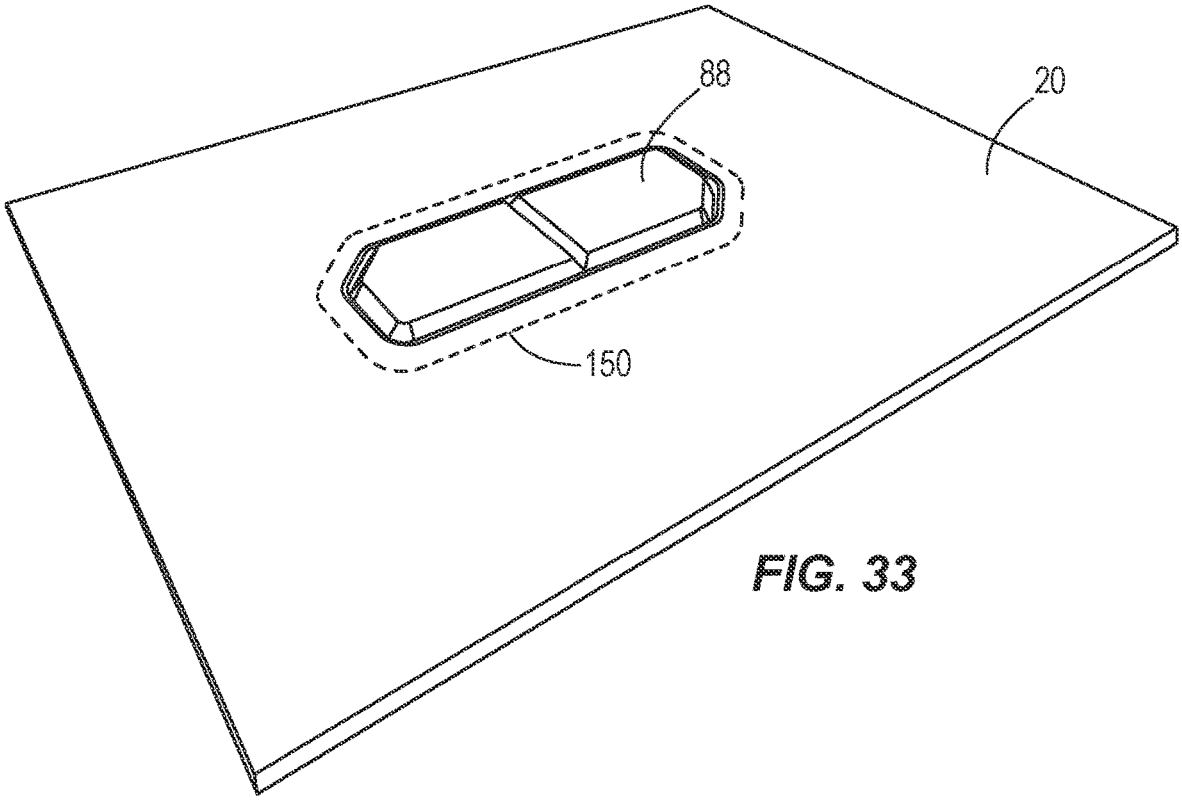
FIG. 33 illustrates yet another method of assembling a jacket.

In another alternative method (see FIG. 32), an adhesive film 148 is placed between the outer shell 20 and the inner shell 22. The adhesive film 148 between the outer shell 20 and the inner shell 22 provides some support for the interface 86. As shown in FIG. 32, the adhesive film 148 is cut in the same shape as the face 88 of the interface 86.

In yet another alternative method (see FIG. 33), a top stitch 150 is added around the shell opening 104 to surround the face 88 of the interface 86. The top stitch 150 also adds support to the shell opening and helps the border 108 to remain close to the edges of the face periphery 92.

Figure 34:
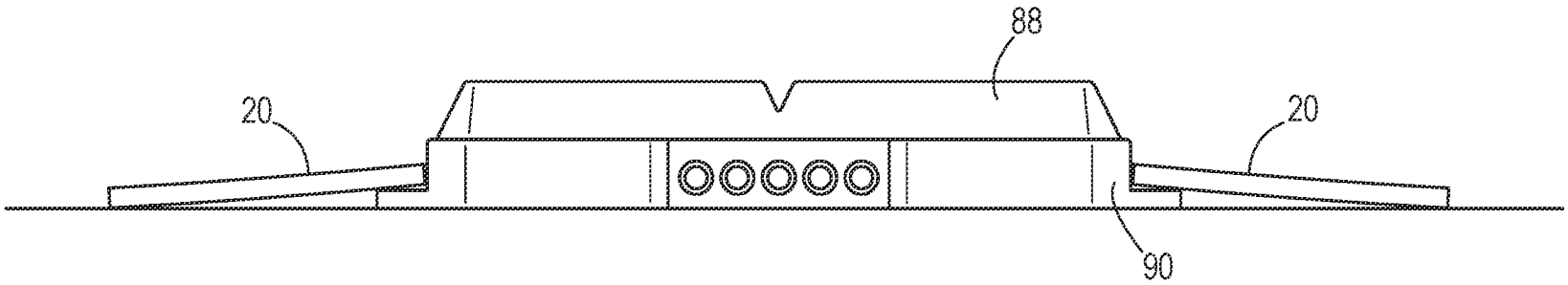
FIGS. 34-35 illustrate a further method of assembling a jacket.
Figure 35:
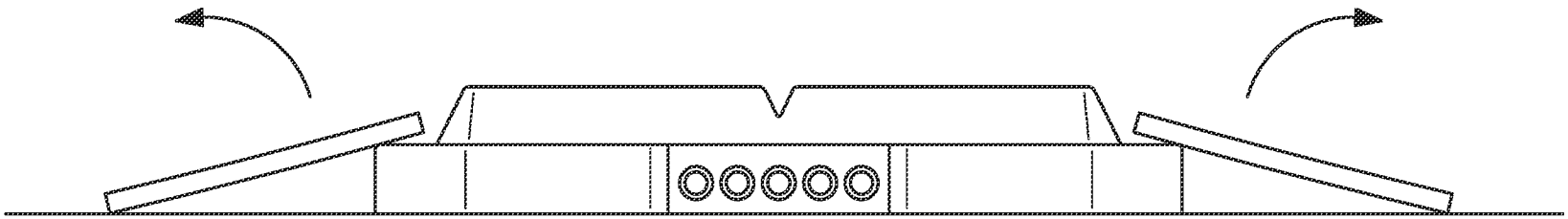
Figure 36:
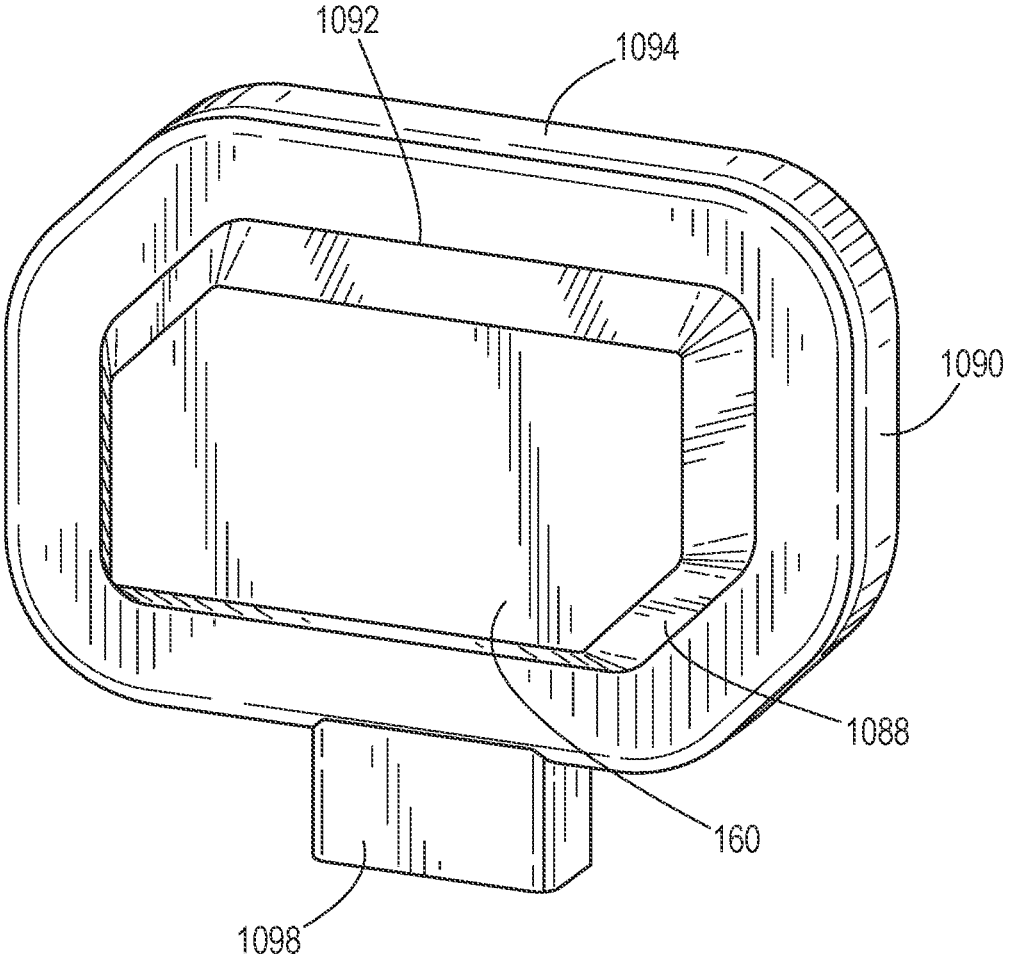
FIG. 36 is a perspective view of an alternative construction of a control button assembly shown in FIG. 27.
Figure 38:
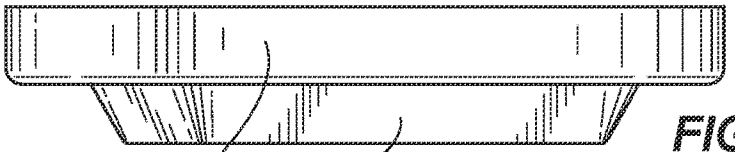
FIGS. 37-41 include various views of the control button assembly shown in FIG. 36.
Figure 37:
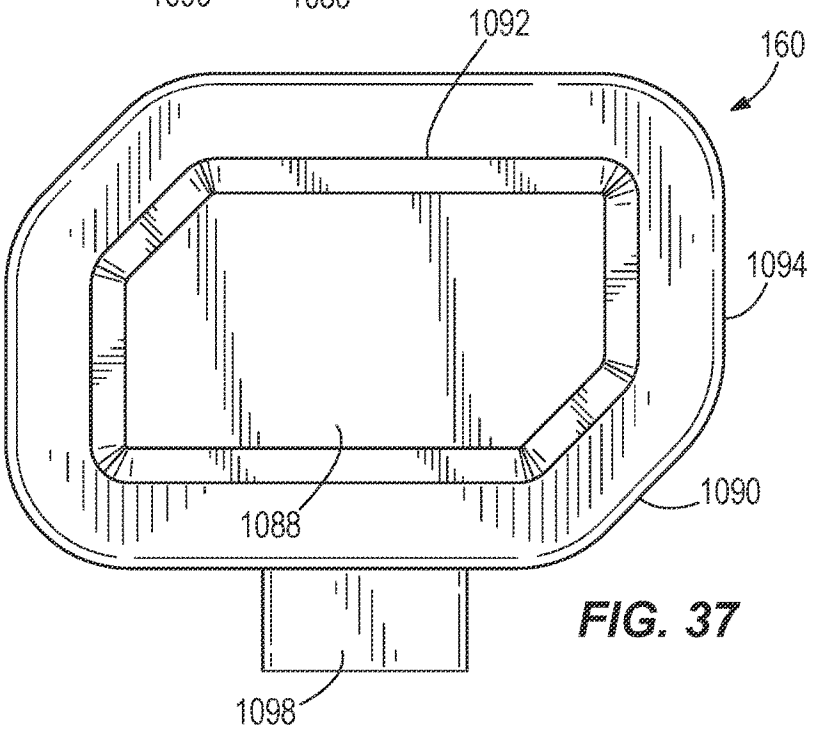
Figure 41:
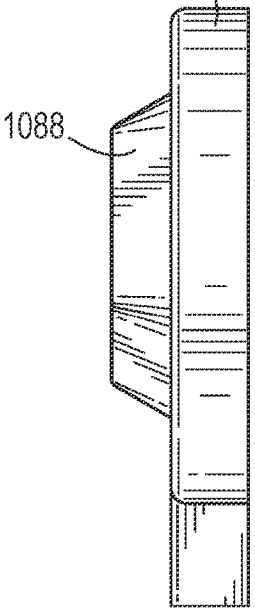
Figure 39:
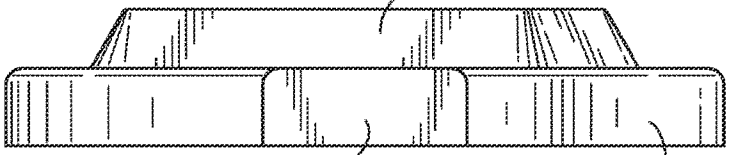
Figure 40:
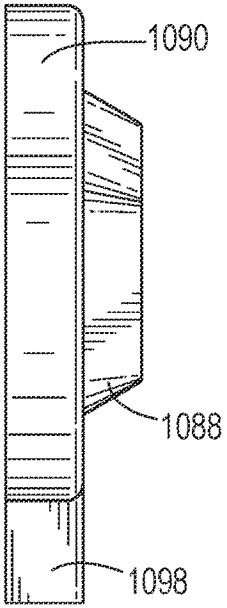

FIGS. 34-35 illustrate reducing a height of the base 90 of the interface 86. FIG. 35 illustrates a larger depth of the base 90 which pushes away the outer shell 20, causing the border 108 of the outer shell 20 to pull away from the face periphery 92. With the reduced height (see FIG. 34), the outer shell 20 is more securely placed and positioned in relation to the interface 86.

Figure 27:
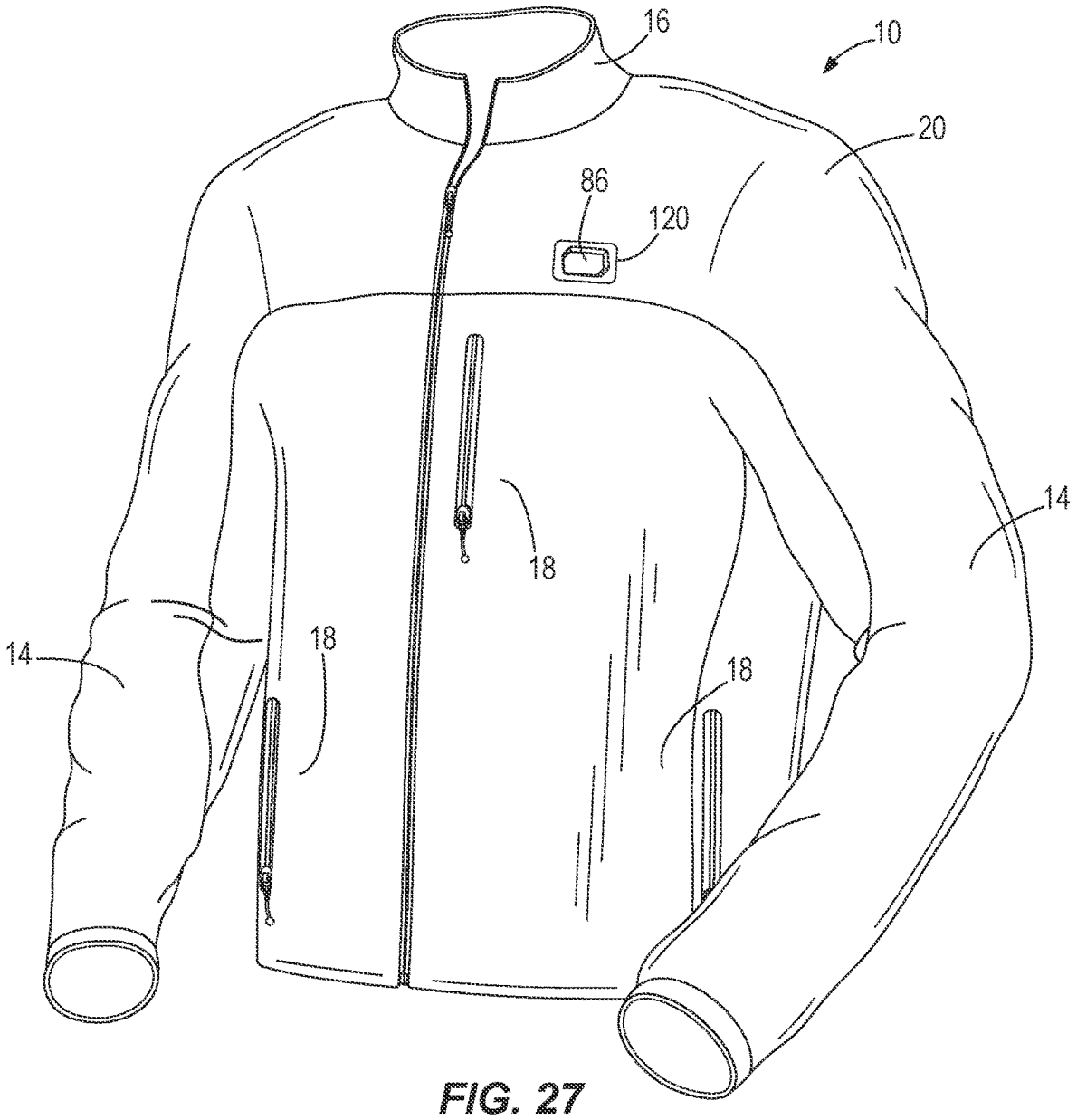
FIG. 27 is a perspective view of an alternative construction of a jacket and a control button assembly.

FIG. 27 illustrates a jacket 10 with an alternative construction of a control button assembly 24. The illustrated jacket 10 includes a border 120 outlining the interface 86, in particular the face 88 of the interface 86.

FIGS. 35-41 illustrate the alternative embodiment of the control button assembly 24 shown in FIG. 27. The illustrated alternative control button assembly 24 includes a single control button 160 instead of two control buttons 76, 78. The control button 160 performs similar functions to the on/off button 76 described above. The control button 160 includes similar components to the interface 86 shown in FIGS. 7-12 and common components have the same reference numbers plus 1000.

Thus, the invention may provide, among other things, an article of clothing, such as a jacket, with a frame to provide support and structure to the outer shell, in particular, near a control button assembly.

One or more independent features and/or independent advantages of the invention may be set forth in the claims.

What is claimed is:

1. An article of clothing comprising:

an electronic button assembly including an interface having a face defining a face periphery including a first top edge, a first bottom edge, a first right edge, a first left edge, a first lower slanted corner, and a first upper slanted corner, and a base defining a base periphery extending beyond the face periphery on all sides to provide structural support to the face, the base periphery having a shape complimentary to a shape of the face periphery and including a second top edge, a second bottom edge, a second right edge, a second left edge, a second lower slanted corner, and a second upper slanted corner;

a heater electrically coupled to the electronic button assembly; and an outer shell coupled to the electronic button assembly, the outer shell having an outer surface and sewing edges, the sewing edges being folded inwardly and defining a shell opening receiving the interface, a shape of the shell opening following the shape of the face periphery, the base being disposed beneath the outer shell.

2. The article of clothing of claim 1, wherein the interface generally has a rectangular shape with two opposite corners cut-out as defined by the first top edge, the first bottom edge, the first right edge, the first left edge, the first lower slanted corner, and the first upper slanted corner.

3. The article of clothing of claim 2, wherein the first top edge and the first bottom edge are parallel, wherein the first right edge and the first left edge are parallel, and wherein the first lower slanted corner and the first upper slanted corner are parallel.

4. The article of clothing of claim 1, wherein the electronic button assembly includes at least two control buttons disposed within the face periphery.

5. The article of clothing of claim 4, wherein the at least two control buttons include a first heater control button and a second heater control button.

6. The article of clothing of claim 5, wherein the first and second heater control buttons are configured as push buttons.

7. The article of clothing of claim 5, wherein the first heater control button is an on/off button, and wherein the second heater control button includes indicia depicting two hands.

8. The article of clothing of claim 1, wherein the interface includes a heater control button configured as a push button, wherein the push button is configured to turn the heater on, change a thermal output setting of the heater, and turn the heater off.

9. The article of clothing of claim 8, wherein the push button is configured to change the thermal output setting of the heater according to a sequence, wherein the sequence includes high, medium, and low.

10. The article of clothing of claim 1, further comprising a protective layer defining an opening aligned with the shell opening, wherein the sewing edges are folded inwardly toward the protective layer and attached to the protective layer.

11. The article of clothing of claim 10, wherein the shape of the opening and the shell opening follows the shape of the face periphery of the interface.

12. The article of clothing of claim 10, wherein the protective layer is disposed between the outer shell and the base.

13. The article of clothing of claim 10, wherein the protective layer is a first protective layer, further comprising a second protective layer disposed on a back side of the interface.

14. The article of clothing of claim 1, wherein the face has a depth such that the face protrudes from a plane of the base.

15. The article of clothing of claim 1, wherein the face is accessible to a user through the shell opening.

* * * * *